US008460129B2

(12) United States Patent
Forlini et al.

(10) Patent No.: US 8,460,129 B2
(45) Date of Patent: Jun. 11, 2013

(54) BACKSTOP RETRIEVING DEVICES AND METHODS THEREOF

(76) Inventors: Tracy Forlini, West Haven, CT (US); Brian Goldwitz, West Haven, CT (US)

( * ) Notice: Subject to any disclaimer, the term of this patent is extended or adjusted under 35 U.S.C. 154(b) by 0 days.

(21) Appl. No.: 13/592,249

(22) Filed: Aug. 22, 2012

(65) Prior Publication Data

US 2013/0059681 A1 Mar. 7, 2013

Related U.S. Application Data

(63) Continuation of application No. 12/132,617, filed on Jun. 4, 2008, now abandoned.

(60) Provisional application No. 60/943,070, filed on Jun. 11, 2007.

(51) Int. Cl.
*A63B 69/00* (2006.01)
*A63B 63/08* (2006.01)

(52) U.S. Cl.
USPC ..... 473/435; 473/479; 473/487

(58) Field of Classification Search
USPC ..... 473/435, 434, 422, 472, 476, 479, 473/446, 481, 487; 482/129
See application file for complete search history.

(56) References Cited

U.S. PATENT DOCUMENTS

| | | | | |
|---|---|---|---|---|
| 1,924,757 | A * | 8/1933 | Shisoff | 473/433 |
| 3,901,506 | A * | 8/1975 | Caveney | 473/433 |
| 4,846,469 | A * | 7/1989 | Nye | 473/486 |
| 4,869,502 | A * | 9/1989 | Wares | 473/433 |
| 5,098,093 | A * | 3/1992 | Dupre | 473/483 |
| 5,129,648 | A * | 7/1992 | Sweeney et al. | 473/433 |
| 5,312,099 | A * | 5/1994 | Oliver, Sr. | 473/433 |
| 5,785,616 | A * | 7/1998 | Dodge | 473/479 |
| 6,074,313 | A * | 6/2000 | Pearson | 473/433 |
| 6,267,696 | B1 * | 7/2001 | Mabe et al. | 473/433 |
| 6,334,822 | B1 * | 1/2002 | Zider | 473/479 |
| 6,554,724 | B2 * | 4/2003 | Taylor | 473/447 |
| 6,595,877 | B2 * | 7/2003 | Pearson | 473/433 |
| 6,659,892 | B2 * | 12/2003 | Lytle et al. | 473/434 |
| 6,746,348 | B2 * | 6/2004 | Barnes et al. | 473/433 |
| 6,849,009 | B1 * | 2/2005 | Forlini | 473/446 |
| 6,913,551 | B1 * | 7/2005 | Foley | 473/448 |
| 7,175,548 | B2 * | 2/2007 | McNulty | 473/431 |
| 7,290,744 | B2 * | 11/2007 | Baldasari | 248/218.4 |
| 7,510,492 | B2 * | 3/2009 | Hudson | 473/433 |
| 7,530,909 | B2 * | 5/2009 | Thomas et al. | 473/433 |
| 2009/0069124 | A1 * | 3/2009 | Forlini et al. | 473/435 |

FOREIGN PATENT DOCUMENTS

DE 3901506 A1 * 8/1990

* cited by examiner

*Primary Examiner* — Mitra Aryanpour
(74) *Attorney, Agent, or Firm* — Julio M. Loza; Loza & Loza, LLP

(57) ABSTRACT

A back stop device suitable for coupling to a backboard assembly in a sporting activity is disclosed. The device includes a central member. The central member couples to one or more clamps which couple to the backboard assembly. The central member may be coupled to a portion of one or more pivot members. One or more arm members may be coupled to a portion of each of the pivot members. The arm members may be selectively repositionable when used in conjunction with the pivot members. One or more netting members may be coupled to a portion of at least one of the central member and one or more of the arm members or a portion of the backboard assembly. The netting members may be configured to deflect a ball in a direction determined by the position of the members with weights coupled to a bottom portion of the netting members.

6 Claims, 18 Drawing Sheets

BACKSTOP RETRIEVING DEVICES AND METHODS THEREOF

CROSS-REFERENCE TO RELATED APPLICATION

This application Claims the Priority Date of U.S. Provisional Application No. 60/943,070, filed Jun. 11, 2007, entitled "Oral Tablet Dosage Forms", with all disclosers being named.

FIELD OF THE INVENTION

This invention generally relates to ball sports and exercise backstop systems and more specifically to net-type backstops that may be suspended from a universally positionable assembly including one or more nets that may be configured as backstop devices and kits. The backstop devices may be used in various ball sports that return one or more balls to a user and/or conveniently retrieve and store the balls after use. The invention also incorporates methods of using and assembling the backstop devices.

BACKGROUND OF THE INVENTION

In the past, various types of backstops have been used in sports activities. Such backstops permit a ball to be returned to a user or act as boundaries that define when a goal has been made or missed by an opponent. Thus, backstops are an essential part of any sport where they act as a targeting area for one or more players of the sport.

Many examples of backstops exist in a variety of sports. By way of example, backstops are used in basketball (the rebound board behind a hoop), ice or field hockey, soccer, lacrosse (the frame structure and net define the boundaries that let opponent sides know when a goal has been achieved). In other sports, the backstops may be manifested as golf nets for practicing drives. For tennis and badminton nets, the poles either side of a ret between players on opposing sides together with the net define one boundary that the players must navigate. For baseball, a net may be mounted around one or more portions of a field so that when a player wishes to practice slugging the ball the net may be used to stop a flying ball conveniently from exiting a certain area of the field. It will be appreciated that during practice sessions a great number of balls (or pucks) may be used by players who may be practicing their skills, and after a period of time such balls need to be retrieved.

Currently, various devices have been used to collect wayward balls and pucks, which are well known in the art. Various other devices have also been disclosed to return a ball to a player without using many balls. Thus, the features of a backstop device may be modified to enable return of the ball to the player. For example, recently McNulty, U.S. Pat. No. 7,175,548 disclosed a universal position-adjustable backstop net system which is described in greater detail below. In yet another example, one of the applicants of the current disclosure Forlini, U.S. Pat. No. 6,849,009 previously disclosed a practice backstop/net system that was described for use in the game of hockey, but also could be used in various other sports activities. The current disclosure incorporates by reference all material disclosed in U.S. Pat. No. 6,849,009.

While the above-described disclosures describe various devices and methods relating how one or more wayward balls may be conveniently returned to one or more players, the current applicants has found that these devices and methods may be improved.

SUMMARY OF THE INVENTION

In general, and without limiting the current disclosure, practice in a ball sport, such as basketball may be facilitated by providing for the automated return of errant basketball attempts to a user. More specifically, the disclosure generally comprises a netting assembly associated with a frame assembly that may be selectively coupled to a basketball backboard. The netting assembly and frame assembly generally provide a return function that collects and returns basketballs (for example) to the user. The netting assembly may be disposed substantially about the basketball backboard in dimensions sufficient to catch errant balls and redirect the balls to the user. As it relates to redirecting balls, the netting assembly and the frame assembly may be selectively adjusted in a manner that permits the user to redirect a ball's recoil direction. For example, if the user was practicing a shot from the top of the key, the netting assembly and frame assembly could be adjusted to redirect errant balls to the top of the key, corresponding to the location of the user.

In accordance with an embodiment of this invention, a backstop device suitable for coupling to a backboard element in a sporting activity is disclosed. The device includes a central member having a first end and a second end. The central member includes one or more clamps for coupling the central member to the backboard. The first end of the central member may be coupled to a portion of a first pivot member and the second end of the central member may be coupled to a portion of a second pivot member. One or more members may be coupled to a portion of each of the pivot members, thus providing a convenient "arm repositioning" feature. Thus, the arm members may be selectively repositionable when used in conjunction with the pivot members. One or more netting members may be coupled to a portion of at least one of either the central member or one or more of the members. The netting members may be configured to deflect a ball in a direction determined by the position of the members.

The backstop may further comprise at least one weight attached to a lower portion of the one or more netting members to configure the direction of roll of a deflected ball selectively and further stabilize the backstop device. Various other aspects of the backstop device are also disclosed.

In another aspect of the disclosure, the backstop device stay be configured as one or more kits, which may be coveniently shipped to a user.

In another aspect of the disclosure, various different backstop devices are disclosed.

In yet another aspect of the disclosure, methods for using the backstop devices in a variety of sport activities is disclosed.

Furthermore, according to an embodiment of the disclosure a back stop device adapted for coupling to a backboard comprises, in combination, a central member having a first end and a second end, the central member including means for selectively coupling a portion of the central member to the backboard. A portion of an end of the first end of the central member may be coupled to a portion of an end of a first pivot member and a portion of the second end of the central member may be coupled to a portion of an end of a second pivot member. At least one arm member may be pivotally coupled to a portion of each of the pivot members, wherein the at least one arm member is selectively repositionable. At least one netting member may be coupled to a portion of at least one of the following: the central member and the at least one arm member. The netting member may be configured to deflect a ball in a direction determined by the position of the at least one arm member.

In another aspect, the means for coupling the central member to the backboard comprises at least one clamp member.

In yet another aspect, the backstop device further comprises at least one weight coupled to a lower portion of the at least one netting member to selectively configure the direction of roll of a ball deflected from a portion of the at least one netting member. Further the backstop device may comprise three weights coupled to a lower portion of the at least one netting member thereby defining the direction of roll of a ball deflected from a portion of the at least one netting member.

In another aspect, the backstop device further comprises at least one break-away assembly having a first wall member and an opposing second wall member. Each of the wall members define a channel configured to receive a portion of the at least one arm member. A portion of an inner surface of each of the first wall member and of the second wall member may have one or more detents configured no selectively engage a portion of an outer surface of the at least one arm member thereby providing a safety feature. Further, each of the first wall member and the second wall member may have one or more openings corresponding to one or more openings of the at least one arm member.

In yet another aspect, the backstop device further comprises at least one fastener member coupled to a portion of the first wall member, a portion of the second wall member and a portion of the at least one arm member. Yet further, the backstop device may comprise at least one fastener member adapted to shear at a predetermined weight. The at least one fastener member may be coupled to a portion or the first wall member, a portion of the second wall member and a portion of the at least one arm member.

In another aspect, the break-away assembly device further comprises a reinforcement member having a first end and a second end. A portion of the first end of the reinforcement member is coupled to a portion of the break away assembly, and a portion of said second end of the reinforcement member is coupled to a portion of the break-away assembly adjacent to the first end.

In yet another aspect, the break-away assembly further comprises a loop member having an opening configured to receive a portion of the netting member to enhance tension on an upper portion of the netting member.

In another aspect, the backstop device comprises two clamp members with each of the two clamp members having at least one adjusting member to selectively couple a portion of the two clamp members to a portion of the backboard. Furthermore, each of the two clamp members may have at least a pair of projecting members configured to securely receive a portion of the central member.

According to another embodiment of the disclosure, a backstop device is disclosed. The device comprises, in combination, a substantially central member having an end and an opposite end. A portion of an end of a first arm member is pivotally coupled to a portion or an end of a first pivot member. A portion of an opposite end of the first pivot member is coupled to a portion of the end of the central member. A portion of an end of a second arm member is pivotally coupled to a portion of an end of a second pivot member. A portion of an opposite end of the second pivot member is coupled to a portion of the opposite end of the central member. A portion of an end of each of a pair of clamp members is selectively coupled to a portion of the central member and a portion or an opposite end of each of the pair of clamp members is selectively coupled to a portion of a backboard. A portion of an end of at least one netting member is selectively coupled to at least a portion of the first arm and to a portion of the second arm. A portion of an opposite end of the at least one netting member is selectively coupled to at least one weight member. When at least one of the first arm member and the second arm member have a preselected directionality associated with the pivot member, a ball directed at a portion of the at least one netting member substantially returns to an original direction of release of the ball.

In an aspect, the device further comprises a plurality of hook members coupled to a portion of at least one of the first arm member and the second arm member, wherein the plurality of hook members may be configured to selectively receive a portion of the netting member.

In another aspect, the central member comprises one or more arm extension members pivotally coupled to at least one of the following: a portion of an end of the central member and a portion of an opposite end of at least one of the first arm member and the second arm member.

In yet another aspect, at least one of the first pivot member and the second pivot member comprises a block member having an opening configured to couple a portion of the block member to a portion of at least one of the following: an end and an opposite end of the central member.

In another aspect, at least one of the pivot members comprises a plate member having a spring-loaded pin assembly configured to selectively engage a second plate member having a plurality of openings. Further, a hook member may be coupled to a portion of an end of the spring-loaded assembly. A portion of said hook member may include a release rope thereby permitting rotation of at least one or the arm members in a preselected direction.

According to another embodiment of the disclosure, a backstop device as described above, may be configured as a kit. The kit may include one or more clamp members, one or more breakaway assemblies, one or more break-away arm members, one or more portions of a central member, one or more pivot members, one or more netting members, at least one set of assembly instructions and at least one set of fasteners. The kit may be surrounded by at least one packaging material.

According to another embodiment of the disclosure, a back stop device is disclosed. The backstop device comprises, in combination, at least one connector. A portion of the at least one connector selectively couples to a perimeter portion of a backboard assembly. At least a portion of the connector extends a selectable distance adjacent to an edge of the backboard assembly. At least one netting member may be coupled to a portion of the connector or to a portion of the backboard assembly. The netting member may be selectively arranged to deflect a ball in a direction predetermined by the position of the netting member. In an aspect the connector may comprise one or mere clamp members and/or one or more pivot members.

According to another embodiment of the disclosure, a basketball backboard assembly is disclosed. The basketball backboard assembly comprises in combination, a basketball backboard, a support assembly for the basketball backboard and at least one backstop netting member. The backstop netting member is coupled to a portion of at least one of the following: a portion of the basketball backboard and a portion of the support assembly. Further, the at least one netting member may extend a selectable distance adjacent to an edge of the basketball backboard to selectively deflect a ball in a direction predetermined by the position of the at least one netting member. By way of example, the support member may comprise one or more components such as board arm members to elevate or lower the basketball board, a pole, a base member and other associated hardware.

According to yet another embodiment of the disclosure, a method of assembling a backstop device is disclosed. The method comprises various steps. For example, a portion of an end of a first central member may be coupled to a portion of an end of a second central member. A portion of an end of at least one pivot member may be coupled to a portion of an opposite end of the first central member. A portion of an opposite end of the at least one pivot member may be coupled to a portion of an end of at least one break-away assembly. A portion of an opposite end of the at least one break-away assembly may be coupled to a portion of an end of at least one arm member. A portion of one or more edges of one or more netting members may be coupled to a portion of the at least one arm member. One or more clamp members may be coupled to a portion of a backboard. A portion of at least one of the first and the second central members may be coupled to a portion of the one or more clamp members. One or more weights may be coupled to a lower portion of the one or more netting members. One or more portions of the one or more netting members may be coupled to a portion of a backboard assembly.

The foregoing and other objects, features, and advantages of the invention will be apparent from the following, more detailed description of the various embodiments of the invention, as illustrated in the accompanying drawings.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DESCRIPTION OF THE INVENTION

Figure 1:
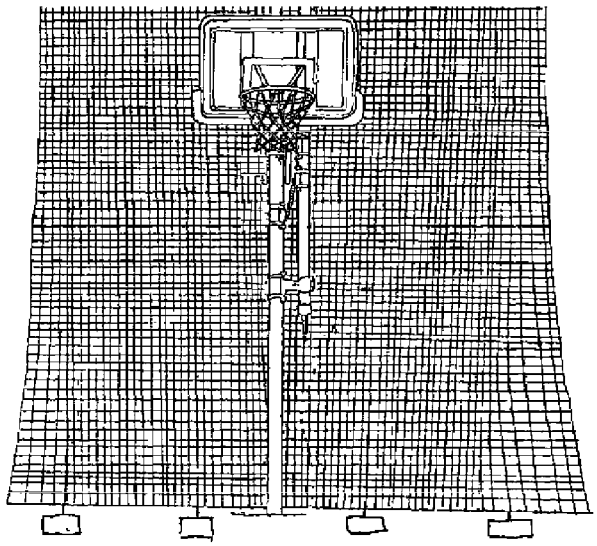
Fig. 1 PRIOR ART
FIGS. 1, 1A-1D depict various views and uses of a prior art backstop device according to the disclosure of McNulty, U.S. Pat. No. 7,175,548.

In the following description, numerous specific details are set forth in order to provide a more thorough description of the present invention. However, it will be apparent to one skilled in the art, that the present invention may be practiced without these specific details. In other instances, well-known features nave not been described in detail so as not to obscure the invention.

In this regard, the invention is illustrated in the several figures of various aspects of the invention, and is of sufficient complexity that the many parts, interrelationships and sub-combinations thereof may be generally illustrative of the inventive features. For clarity and conciseness, several of the drawings may be shown in schematic, or omit, parts that are not essential in that specific drawing to a complete description of a particular feature, aspect or principle of the invention being disclosed. Thus, the best mode embodiment of one feature may be shown in one drawing, and the best mode of another feature may be called out in another drawing.

The Figures are numbered and annotated so that one skilled in the art of netted backstop assemblies use and construction will easily be able to understand the materials and method of construction by reference to the Figures and will easily be able to assemble the parts to achieve the functionality shown.

In the Summery and Preferred Embodiments above, the Description of the Invention, and the Claims and Abstract below, and in the accompanying drawings, reference may be made to particular features (including method steps) of the invention. It is to be understood that this disclosure includes most possible combinations of such particular features. For example, where a particular feature is disclosed in the context of a particular aspect or embodiment of the invention, or a particular claim, that feature may also be used, to the extent possible, in combination with and/or in the context of other particular aspects and embodiments of the invention, and in the invention generally.

The term, "comprises" and grammatical equivalents thereof are used herein to mean that other components, ingredients, steps etc, are optionally present. For example, an article "comprising" (or "which comprises") components A, B and C can consist of (i.e. contain only) components A, B and C, or can contain not only components A, B and C but also one or more other components.

Where reference is made herein to a method comprising two or more defined steps, the defined steps may be implemented in any order or simultaneously (except where the context excludes that possibility). Moreover, the method may include one or more other steps that may be implemented before any of the defined steps, between two of the defined steps, or after all the defined steps (except where the context excludes that possibility).

The term "at least" as denoted herein means one or more, while the term a "plurality" means two or more.

The term "or" is used herein as a conjunction used to link alternatives in a series of alternatives. The term "and/or" is used herein as a conjunction meaning that either or both of two options may be valid.

The term "and" is used herein as a conjunction to indicate an additional thing situation or fact.

When used in the appended claims the term "comprising at least one of A and B" as used herein (depending on the context of the specification) may mean "comprising either one of A or of B (and more), or comprising both of A and of B (and more)". As is understood in the patent art, "comprising A" means "A and more", while "comprising B" means "B and more". Thus if A is excluded according to the context of the specification in the phrase "comprising at least one of A and B", then A cannot be part of the "and more", and similarly for B if B is excluded according to the context of the specification.

The present disclosure is applicable to any sport that uses a ball and a goal, such as basketball, hockey, lacrosse, field hockey, and the like. However, for ease of discussion, example reference will be made throughout to the disclosure's applicability to basketball, but it is to be understood that such reference is by way of illustration only, and is not intended to limit the scope of the present invention.

Figure 1A:
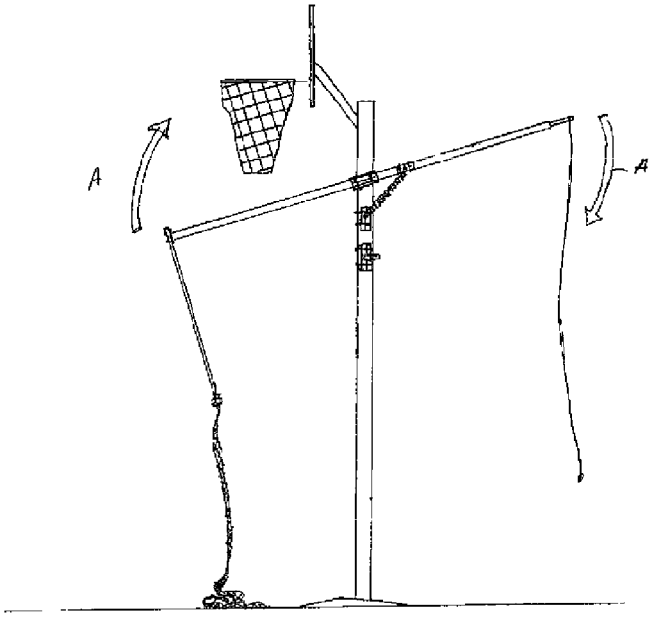

FIGS. 1 and 1A depict a prior art backstop device coupled to a basketball backboard according to the disclosure of McNulty, U.S. Pat. No. 7,175,548. As shown in FIGS. 1 and 1A, the McNulty backstop device comprises substantially a straight member configured with a netting material wherein a bottom portion of the netting material is weighed down with one or more sandbags. The basketball board is coupled to a pole which may be raised and lowered as desired as is well understood in the art. Referring to FIG. 1A, a portion of the straight member of the McNulty backstop device is coupled to the pole and the backstop device may be rotated up and down relative to the direction of the pole (arrows A, A and see also FIG. 1B). Significantly, the netting material remains substantially parallel to the direction of the straight member. Consequently, on recoil when a ball contacts the netting material after a missed shot, the ball would roll back in various uncontrolled directions depending on the angle at which a player faced the netting material.

Figure 1C:
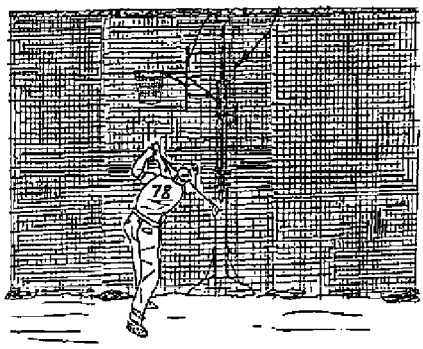
Figure 1B:
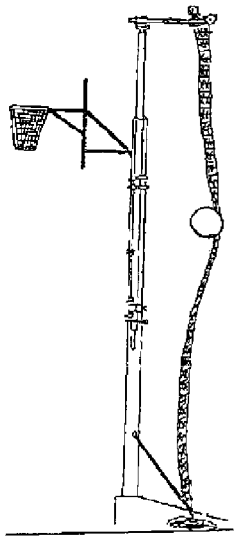
Fig. 1B PRIOR ART
Figure 1D:
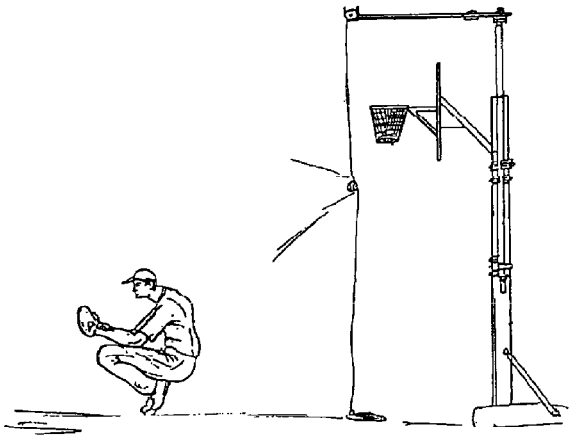

FIGS. 1C and 1D illustrate various configurations wherein the McNulty backstop device may be configured for use in various sports (FIG. 1C shows the netting used for a golfer and FIG. 1D shows the netting used for a baseball player). These FIGS. 1C-1D have been included in this disclosure to illustrate that the current applicants' unique backstop devices may be similarly configured for use with various sports, although, of course (see description below with reference to FIGS. 3 to 6), the current applicants' devices are significantly different both in configuration and method of use as compared to McNulty.

Figure 2:
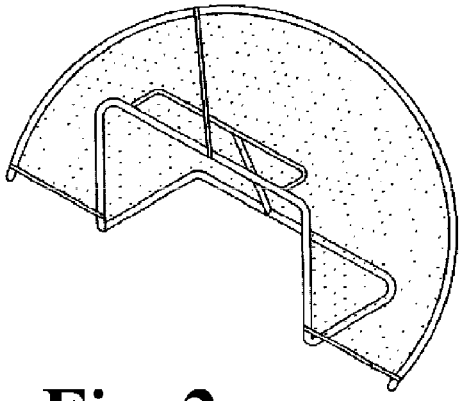
Fig. 2 PRIOR ART
FIGS. 2, 2A-2C depict various views of various aspects of other prior art backstop devices according to the disclosure of Forlini, U.S. Pat. No. 6,849,009.
Figure 2A:
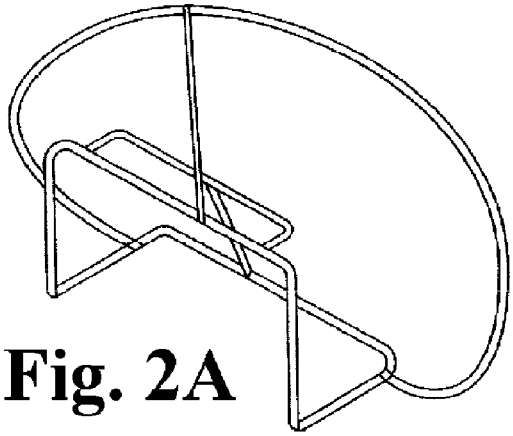
Figure 2B:
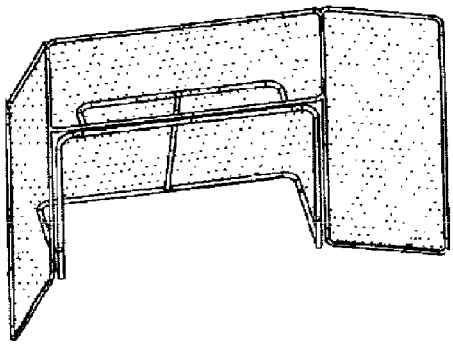
Figure 2C:
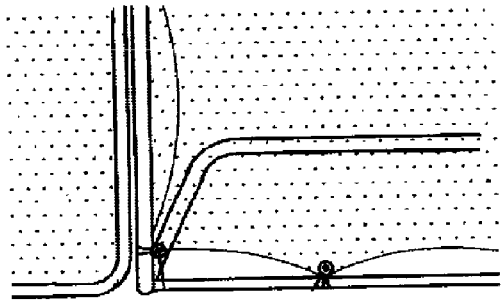

FIGS. 2, 2A-2C depict views of various embodiments of other prior art backstop devices according to the disclosure of cue of the current applicants (Forlini, U.S. Pat. No. 6,849,009). As depicted in FIGS. 2, 2A-2B the backstop device has been configured for use with a hockey goal assembly, although it is perfectly clear that the backstop devices may adapted for use with a basketball backboard or any other sport where practice involves skills such as aiming at a target and retrieving a ball or puck and the like. As illustrated in FIGS. 2, 2A-2B the backstop device comprises one or more straight and/or curved members that are coupled to a portion of the hockey goal assembly. A netting material is coupled to the straight and/or curved members and forms a barrier to passage of a wayward puck. Ordinarily, the puck would be deflected to a player at an angle dependent on the player's position and other well understood physical parameters. FIG. 2C illustrates how a portion of the netting material may be coupled to one of the straight and/or curved members using a hoop mechanism. Such hoop mechanisms are well understood in the art and may be incorporated in the current applicants' unique backstop devices (as described below with reference to FIGS. 3 to 6).

Figure 3:
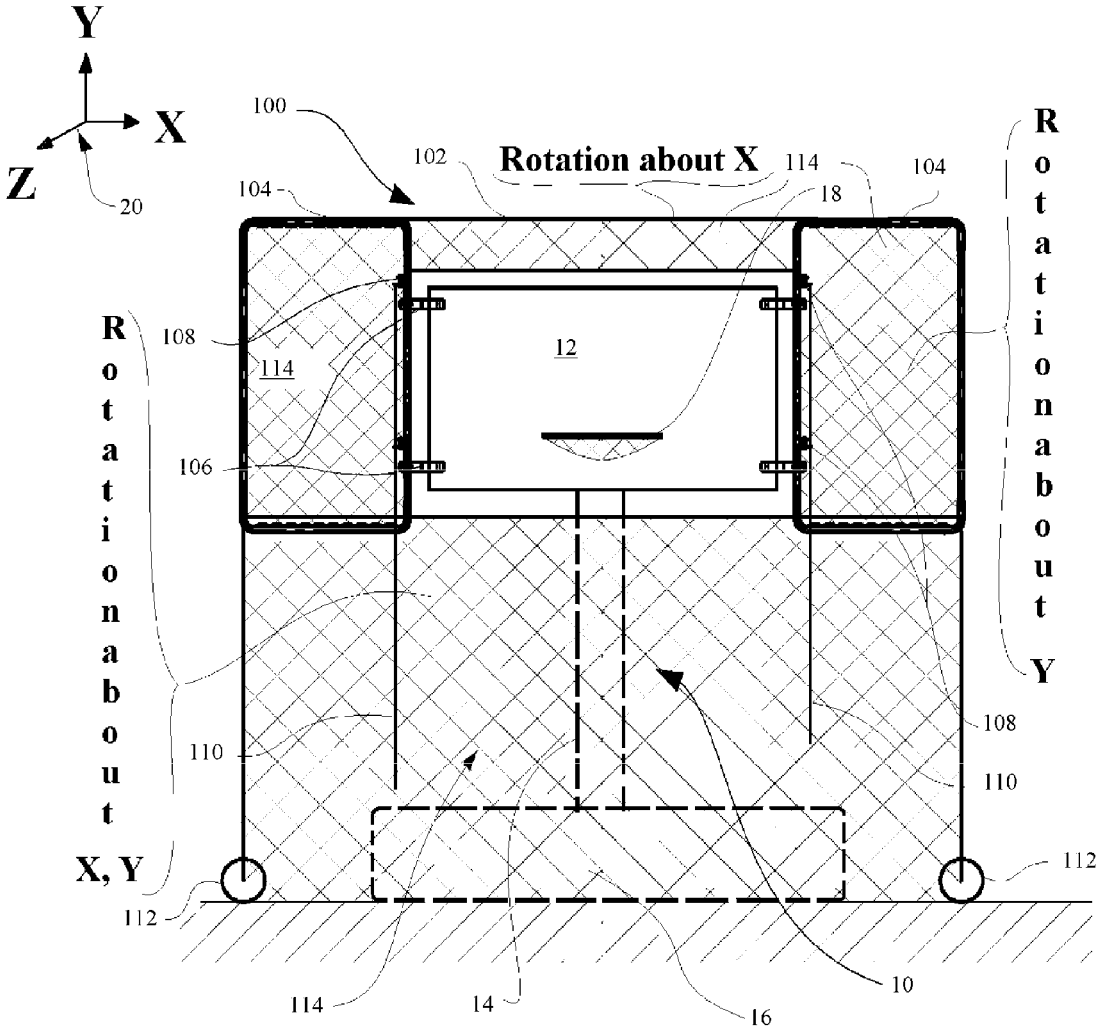
FIG. 3 depicts a front view of an embodiment of a backstop device in accordance with an exemplary embodiment of this invention.

FIG. 3 illustrates a front view of an exemplary embodiment of a backstop device 100 according to this disclosure. The backstop device 100 may be coupled to a basketball board assembly 10 comprising a basketball backboard 12 including a basketball hoop 18. Further, the basketball backboard is coupled to a substantially vertical pole member 14 and the vertical pole member is coupled to a base member 16. The basketball board assembly 10 may be selectively raised and lowered as is well understood in the art. Of course it is understood that the backstop device 100 may be coupled to any suitable member such as a cross member and the like.

With further reference to FIG. 3, the backstop device 100 may comprise one or more substantially rectangular horizontal members 102 coupled to one or more substantially rectangular vertical members (or wings or arms) 104. As depicted in FIG. 3, the one or more substantially rectangular horizontal members 102 may rotated about an X axis as defined by a reference XYZ co-ordinate system 20 shown in FIG. 3 and the substantially rectangular vertical members 104 may be rotated about a Y axis as defined by the reference XYZ co-ordinate system. Furthermore, the backstop device 100 may comprise one or more clamp members 106 adapted to couple a portion of the backstop device to a portion of the basketball backboard 12. A portion of the clamp members 106 may be coupled to a pivot element or alternatively as illustrated in FIG. 3, the substantially vertical members 104 may be coupled directly to one or more pivot elements 108 as is understood in the art to facilitate rotation of the substantially vertical members about the Y-axis as described previously. The pivot elements 108 may be coupled to one or more ropes, strings or chains and the like 110 that activate a mechanism to permit selective rotation of the vertical members 104 (described in greater detail with reference to FIGS. 4 and 5 below) without needing to climb a ladder to reset the direction of the vertical members. It will be appreciated that this pivot element feature has numerous advantages over other adjusting methods in the current art of backstop devices.

Additionally the backstop device 100 may comprise one or more netting members 114 (as described previously with reference to the prior art backstop devices of FIGS. 1 and 2). As illustrated in the embodiment of the backstop device 100 of FIG. 3, one or more netting members 114 may be coupled to a portion of each of the vertical members 104 and the horizontal members 102. Such coupling may be accomplished in the manner described above with reference to FIG. 2C. Furthermore, a lower portion of the netting material 114 may be coupled to one or more weights 112. In an aspect of the disclosure, the weights 112 may be sandbags, although it is understood that the weights may comprise any kind of material. Since the weights 112 are coupled to a lower portion of the netting members 114 and the netting members are independently coupled to both the vertical members 104 and the horizontal members 102 (see FIG. 3), it is possible for the netting members to be rotated in both the X and Y directions of the reference XYZ co-ordinate system 20. In an aspect of the disclosure the directionality for retrieving wayward balls hurled at the backboard 12, may be selected by manipulating the vertical members (or arms) 104 thereby changing the surface profile and orientation of the netting members 114. In order to accomplish such directionality, a third sandbag (or weight) 112 may be coupled to a lower portion of the netting members 114 (not shown in FIG. 3, but shown and described below with respect to FIGS. 6A-6G).

In another aspect of the disclosure as further illustrated with reference to FIG. 3, the backboard 12 may include one or more hinge pins for receiving a corresponding hinge portion of the vertical members 104. The hinge portions may be similar to a traditional door hinge. In still another aspect, also applicable to the backstop device 100 and more fully described below with reference to another embodiment of the backstop device 200 (illustrated in FIGS. 5B-5D), a portion of the vertical members 104 may be coupled to a pin mechanism. In operation, tension applied to one or more pins of the pin mechanism allows repositioning of the vertical members 104 and when tension upon the one or more pins is released the vertical members may be selectively secured and fixed in position. The adjustment ropes 110 may be utilized to selectively release the one or more pins.

Figure 3A:
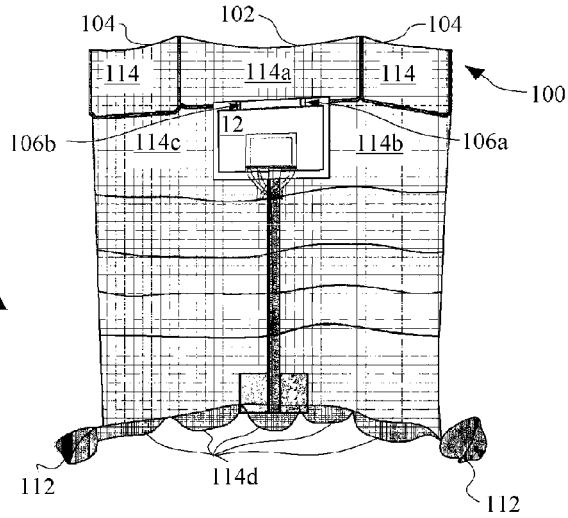
FIGS. 3A-3C depict various front and side perspective views of various configurations of the backstop device of FIG. 3.
Figure 3B:
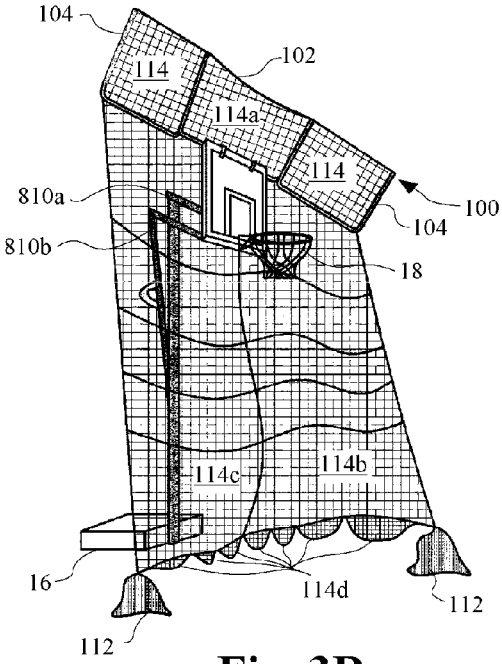
Figure 3C:
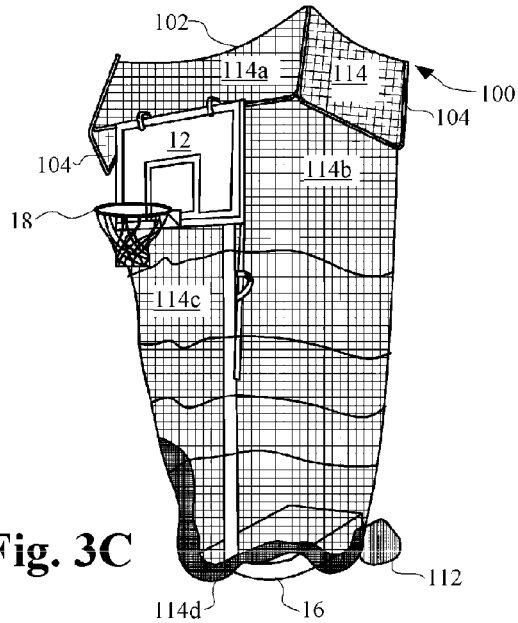

FIGS. 3A-3C depict front and side perspective views of various configurations of the backstop device 100 of FIG. 3. Specifically, with reference to FIG. 3A, in a front perspective view of the backstop device 100, the backstop device includes a netting member 114 coupled to a portion of the vertical members 104 and a netting member 114*a* coupled to the horizontal members 102. Of course, as illustrated in FIGS. 3A-3C, the horizontal members 102 may simply comprise a peripheral portion of the netting member 114*a*. Furthermore, a lower portion of netting members 114*b* and/or 114*c* may be coupled to one or more weights 112 and one or more clamps 106*a*, 106*b* of the backstop device 100 may be coupled to a portion of the basketball backboard 12 as described above (see description of FIG. 3 above). In yet another aspect, as illustrated in FIG. 3A, one or more lower portions 114*d* of the netting members 114*b*, 114*c* may be folded on themselves when it is desired to raise the netting material from a ground surface thereby controlling the height of the netting materials 114*b*, 114*c*. FIG. 3B illustrates that the vertical members 104 may be rotated as desired is a direction towards a user standing in front of the backstop device 100. In contrast, FIG. 3C illustrates a configuration of the vertical members 104 away from a user standing in front of the backstop device 100 wherein she backstop device may be folded away conveniently for future use. Significantly, when a lower portion of the netting members 114*b*, 114*c* is folded as described above, one or more balls may be conveniently stored in a portion of one or more folds 114*d* (see also description below with reference to various aspects of FIGS. 4-6).

Figure 4A:
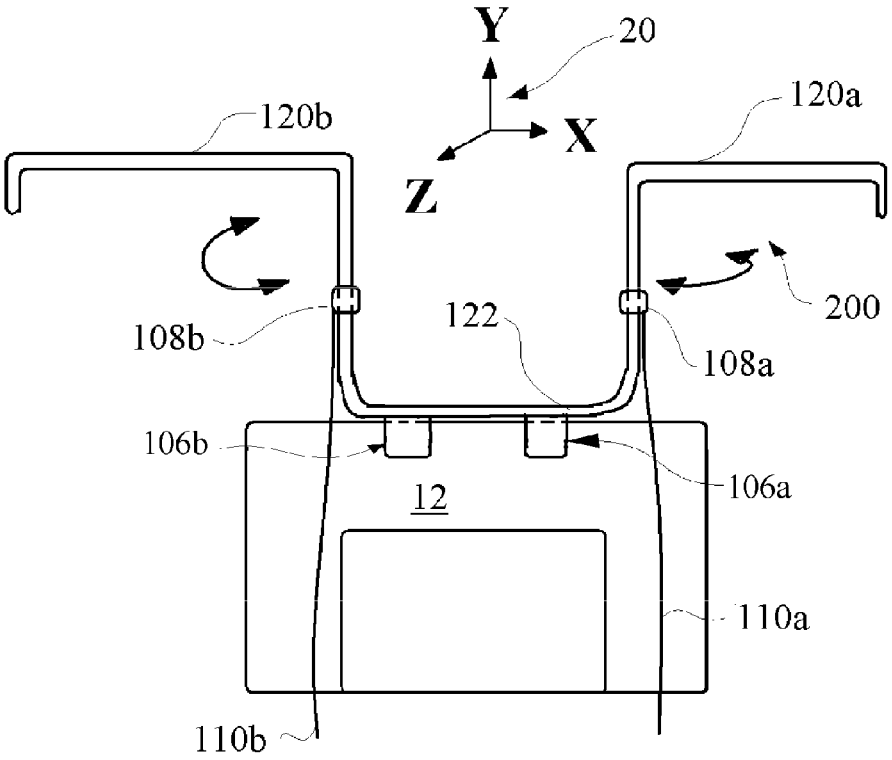
FIG. 4A depicts a front view of another embodiment of a backstop device coupled to a substantially rectangular basketball backboard in accordance with an exemplary embodiment of this invention.

FIG. 4A illustrates a front view of an exemplary embodiment of another backstop device 200 according to this disclosure, without showing the netting members 114. The backstop device 200 comprises a substantially U-shaped central (or inner) member 122 having a first end and a second end. A portion of the first end of the central member 122 may be coupled to a portion of a first pivot element (or member) 108*a* and a portion of the second end may be coupled to a portion of a second pivot element 108*b*. Additionally, it is understood that a portion of the central member 122 may be coupled to a portion of the basketball backboard 12 to provide greater stability of the backstop device 200. Furthermore, the central member 122 may be sized as desired to better co-operate with a basketball backboard 12 (or any other suitable backboard or coupling element). Of course, the central member 122 may comprise a tubular material (or a solid material of any suitable shape as desired) such as any metal or plastic as is currently known or may be known in the art.

Referring further to FIG. 4A, one or more strings (or chains or ropes) 110*a*, 110*b* may be coupled to a portion of each of the pivot members (elements) 108*a*, 108*b* as described earlier with respect to FIG. 3 above. Furthermore, the backstop device 200 may comprise an end of a first member (arm) 120*a* coupled to a portion of the first pivot element 108*a* and an end of a second member (arm) 120*b* may be coupled to a portion of the second pivot member (or element) 108*b*. The first and second members 120*a*, 120*b* may comprise a plastic or metal tubular material (as described above with respect to the central member 122) as is understood in the art. Further, the first member 120*a* and the second member 120*b* may be rotated freely and independently about the Y axis of the reference XYZ co-ordinate system 20 as illustrated in FIG. 4A. Consequently, when one or more netting members 114*b*, 114*c* are coupled to either of a portion of the central member 122, and/or each of the first member 120*a* and the second member 120*b*, one or more of the netting members may be configured to freely receive, and subsequently return a wayward ball thrown towards the basketball backboard 12 (not shown in FIG. 4A but shown in FIGS. 5C, 5D and 6A-6G). Furthermore, the weights (sandbags) 112 coupled to a lower portion of the netting material of the backstop device 200 permit the first member (arm) 120*a* and the second member (arm) 120*b* to provide any suitable shape to the netting members 114 (see FIGS. 6A-6G and the description below). The netting members' shapes may be straight, curved or jagged in any suitable manner because or the pliable nature of the netting material and the counterbalancing weights 112 coupled to the lower portion of the netting material.

With further reference to FIG. 4A, a portion of the central member 122 may comprise one or more clamps 106*a*, 106*b* adapted for coupling to a portion of the basketball backboard 12. As illustrated in FIG. 4A, the clamps 106*a*, 106*b* may comprise a lower substantially vertical extension of the backstop device 200. A lower portion of one or more netting members 114*b*, 114*c* may be coupled to one or more weights 112 (not shown in FIG. 4A but shown in FIGS. 5 C, 5D and 6A-6G) to provide stable shape forming characteristics to the netting members that may largely determine the return path of a ball (as described above).

In another aspect of the disclosure, the strings (or adjustment ropes) 110*a*, 110*b* may couple to an outer portion of the backstop device 200 such that the adjustment ropes drape away from below the basket ball backboard 12. In another embodiment, the bottom portion of the netting members 114*b*, 114*c* may be separate and distinct from the backstop device 200. The bottom portion of the netting members 114*b*, 114*c* may include one or more clips (not shown in FIG. 4A, but described and shown in FIG. 2C above) for attaching the bottom portion to the backboard 12, the pole member 14 or the base member 16 of the basket ball board assembly 10. In other words, any portion of the netting members 114 of the backstop device 200 may be coupled to any portion of basket ball board assembly 10 as desired. Such a bottom portion of the netting members 114*b*, 114*c* may be of approximately the same width as the backboard 12 or larger or smaller as desired. In yet another aspect of the disclosure, the adjustment ropes 110*a*, 110*b* may be coupled to one or more rings (not shown in FIG. 4A but as described and shown in FIG. 2C above) so that the ropes may be removed when adjustment is not desired.

In one aspect of the disclosure the netting members 114*b*, 114*c* may comprise a single netting material 114 wherein a portion of the single netting material may be partially separated from another portion of this netting material so that appropriate drape may be achieved from each of the first and second members 120*a*, 120*b*. Thus in one aspect, the netting material 114 may be slit approximately at the middle of the central member 122 as illustrated in FIGS. 6A-6G to provide netting materials 114*a*, 114*b*. The netting member 114*b*, 114*c* may be configured as a lacing system that uses one or more netting members. Thus, the netting members 114*b*, 114*c* may be laced together to wrap around the backboard 12 (as illustrated and described with reference to FIG. 3C). Alternatively, and without limiting the disclosure, as discussed above, the netting member 114 may have a slit down the middle towards a top portion of the backstop device 200 to lace around a back portion of the backboard 12. Alternatively, two or more parallel nets may be laced together as illustrated in FIGS. 5C, D and 6A-6G). Of course, the netting material may comprise a multiplicity of netting materials to accomplish improved draping. Furthermore, the netting material may comprise any conventional fiber (such as nylon or polyester) that is known or may be introduced into the marketplace in the future.

Figure 4B:
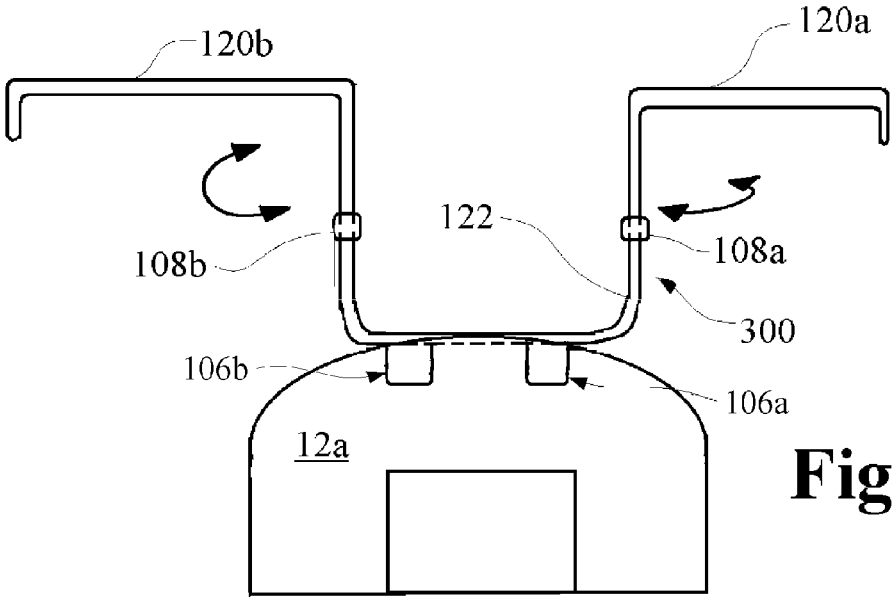
FIG. 4B depicts a front view of another embodiment of a backstop device coupled to another type of basketball backboard that has a curved top in accordance with an exemplary embodiment of this invention.

In yet another exemplary embodiment of a backstop device 300, as illustrated in FIG. 4B, the clamps 106*a*, 106*b* may project outwardly from a portion of the central member 122 (further illustrated and described below with respect to FIG. 4E). Beneficially, a portion of the central member 122 may provide additional clamping support on a back-side portion of the basketball backboard 12 (further illustrated in the top view of FIG. 4E). Of coarse, the backstop devices 200, 300 may also be hooked on the sides or secured through holes drilled through the backboard 12 (not shown). It is understood that the backstop device 300 of FIG. 4B shares common features as described above with respect to the description above of the backstop device 200 of FIG. 4A.

Advantageously, the disclosed backstop devices 100, 200 and 300 collect both successfully made baskets and errant snots for return in the direction of play. Thus, advantageously the time for retrieving a basketball (or in any ball game as described above with which the backstops could be configured) may be minimized during play. Furthermore, since a player is able to recover the ball more quickly, the player tends to increase practice time and train appropriate muscles as well as sight skills more rapidly. Furthermore, a player's exercise routine may be enhanced when using the backstop devices 100, 200 and 300 as described herein.

Figure 4C:
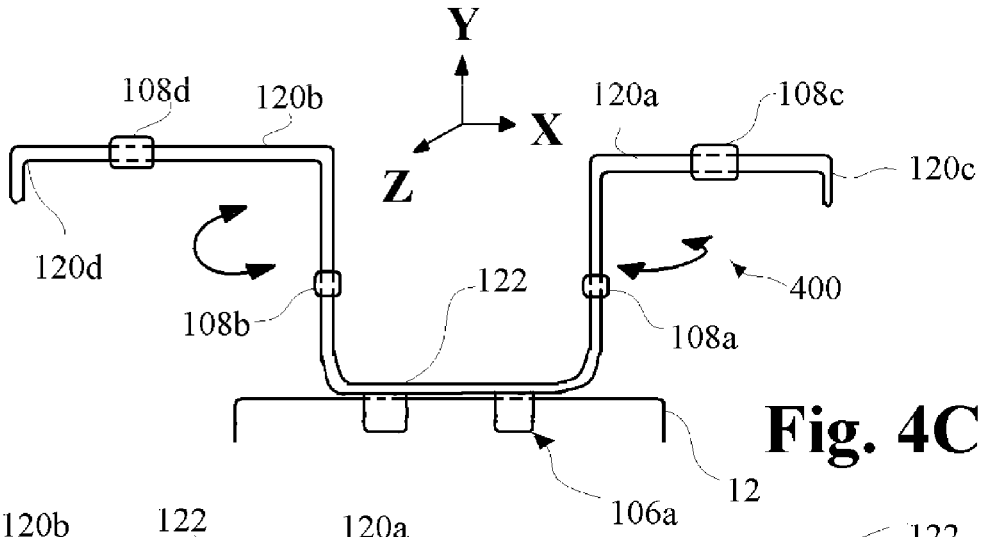
FIG. 4C depicts a front view of yet another embodiment of a backstop device coupled to another type of a substantially rectangular basketball backboard having additional arms in accordance with an exemplary embodiment of this invention.

Referring to FIG. 4C, another embodiment of a backstop device 400 comprises substantially the same features as discussed above with respect to backstop devices 100, 200, 300. However, the backstop device 400 further may comprise one or more extension members 120*c*, 120*d* coupled to yet another one or more pivot members 108*c*, 108*d* through (for example) the first member 120*a*. This provides yet another degree of freedom to configure the net members 114*b*, 114*c* in any desired configuration. Of course, understandably the net members 114*b*, 114*c* could be a single net member 114 as discussed above.

Figure 4D:
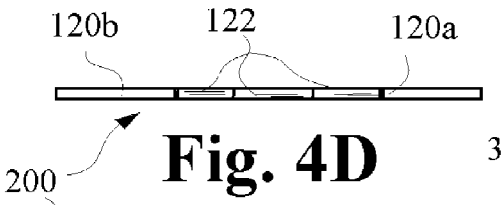
FIG. 4D depicts a top elevation view of a portion of the backstop device of FIG. 4A.
Figure 4E:
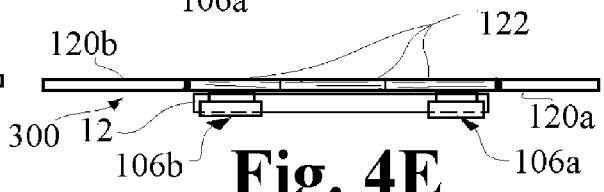
FIG. 4E depicts a top elevation view of a portion of the backstop device of FIG. 4B.
Figure 4F:
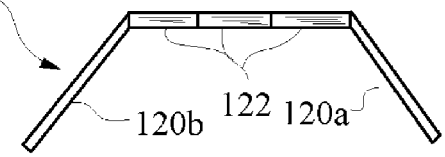
FIGS. 4F-4G depict top elevation views of various configurations of a portion of the backstop device of FIG. 4A.
Figure 4G:
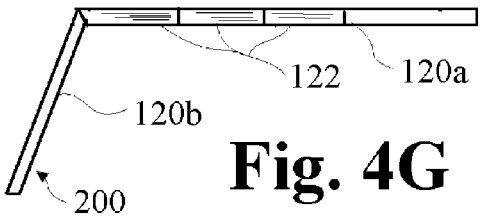
Figure 4H:
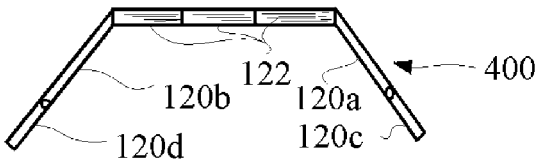
FIG. 4H depicts a top elevation view of a configuration of a portion of the backstop device of FIG. 4C.

FIG. 4D depicts a top elevation view of a portion of the backstop device 200 of FIG. 4A in a straight configuration, while FIG. 4E depicts a top elevation view of a portion of the backstop device 300 of FIG. 4B when a backboard 12 has a curved shape. FIGS. 4F-4G depict top elevation views of various configurations of a portion of the backstop device 200, which may be better understood by reference to the following FIGS. 6A-6G (further described below). FIG. 4H depicts a top elevation view of a configuration of a portion of the backstop device 400 of FIG. 4C which includes one or more extension members 120*c*, 120*d* (only two shown).

Figure 5:
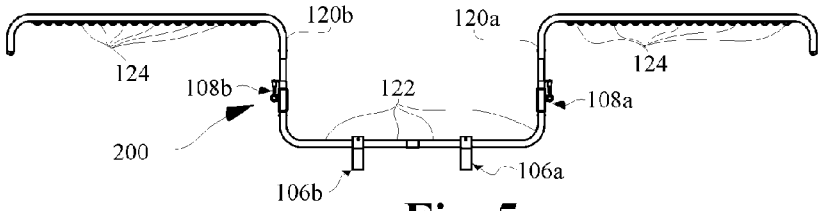
FIG. 5 depicts a front elevation view of an embodiment of the backstop device of FIG. 4A.

FIG. 5 depicts a front elevation view in enhanced detail of an embodiment of the backstop device 200 as described above. The backstop device 200 comprises the central member 122, true arm members 120*a*, 120*b*, the clamp members 106*a*, 106*b*, the pivot members 108*a*, 108*b* and a plurality or hook members 124 coupled to a portion of both the first (arm) member 120*a* end the second (arm) member 120*b*. Of course, the hook members 124 may be configured so receive a portion of the netting member 114 as discussed previously. As illustrated in FIG. 5 (and described in greater detail below with regards to FIGS. 5C, 5D, 5E and 5H) a portion of an end of the first (arm) member 120*a* may be coupled to a portion of an end of the pivot member 108*a*, while a portion of an opposite end of the pivot member 108*a* may be coupled to a portion of an end of the central member 122. Naturally, a portion of an end of the second (arm) member 120*b* may be coupled to a portion of an end of the pivot member 108*b*, while a portion of an opposite end of the pivot member 108*b* may be coupled to a portion of an opposite end of the central member 122. Further, a portion of each clamp member 106*a*, 106*b* may be coupled to a portion of the central member 122. The clamp members 106*a*, 106*b* may be spaced apart to provide grater stability when coupling the backstop device 200 to a portion of the backboard 12 (see FIGS. 4A and 4B and the description above). According to FIG. 5, the central member 122 may comprise two substantially L-shaped members, wherein an end of the first L-shaped member may be coupled to an opposite end of a second L-shaped member. As illustrated in FIG. 5, such coupling may occur between the clamp members 106*a*, 106*b*. Of course, there is no requirement that the central member 122 comprise two L-shaped members. However, when configured in a kit form, such an arrangement may be advantageous to facilitate reduced shipping costs and permit assembly of the backstop device 200 (or any other embodiment of the backstop device as desired).

Figure 5A:
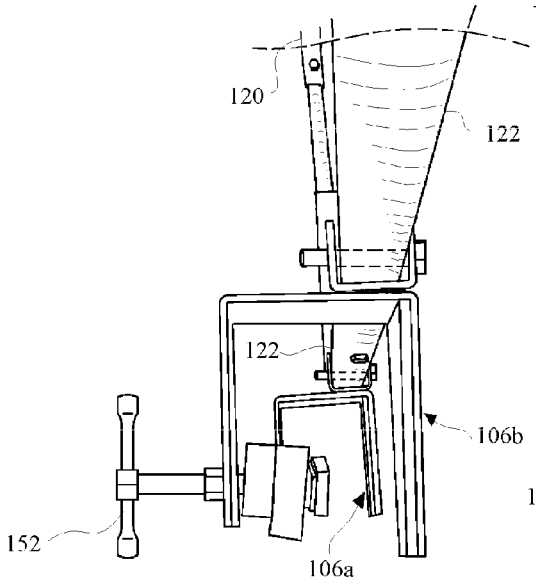
FIG. 5A depicts a side perspective view of an embodiment of one or more clamps of the backstop device of any of FIGS. 4A-4C.

FIG. 5A depicts a side perspective view of an embodiment of one or more clamp members 106*a*, 106*b* of any of the embodiments of the backstop devices 200, 300, 400 as described above (and other embodiments of backstop devices 500 and 600 described below). As illustrated in FIG. 5A, the clamp member 106*a* (or 106*b* hidden behind the clamp member 106*a*) has a standard screw type adjusting member 152 to facilitate coupling to a portion of the backboard 12 (see FIG. 5S and the description below for additional aspects of the clamp members 106). In general, the clamp members 106*a*, 106*b* may suitably provide means for selectively securing a portion of the backstop device 200 together with associated netting members 114 to a portion of the backboard 12. The clamp members 106*a*, 106*b* may be provided as any structure capable of enabling secure association of one backstop device 200 to the backboard 12. Example clamp members 106*a*, 106*b* may include adjustable clamps, ratcheting clamps, permanent adhesive, and the like. Naturally, in advantageous configurations, the clamp members 106*a*, 106*b* facilitate efficient connection/dissociation of the backstop device's central member 122 to the backboard 12. Additionally, in an aspect, the clamp members 106*a*, 106*b* permit association of the backstop device 200 with any size, shape or configuration of basketball or similar sports backboard.

Figure 5B:
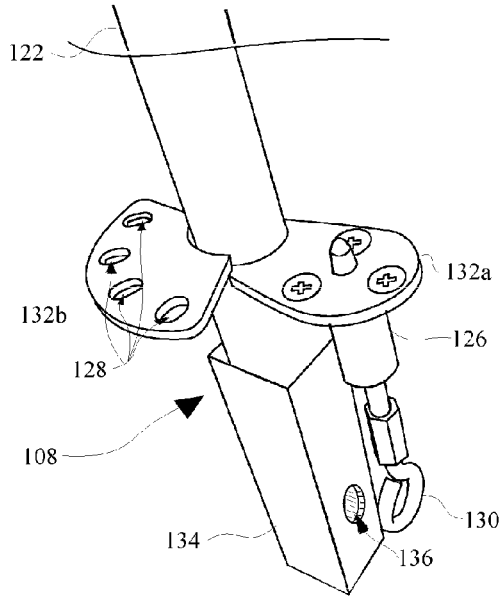
FIG. 5B depicts a front perspective view of an embodiment of a pivot member to facilitate selective configuration of one or more arms of the backstop device of any of FIGS. 4A-4C.
Figure 5C:
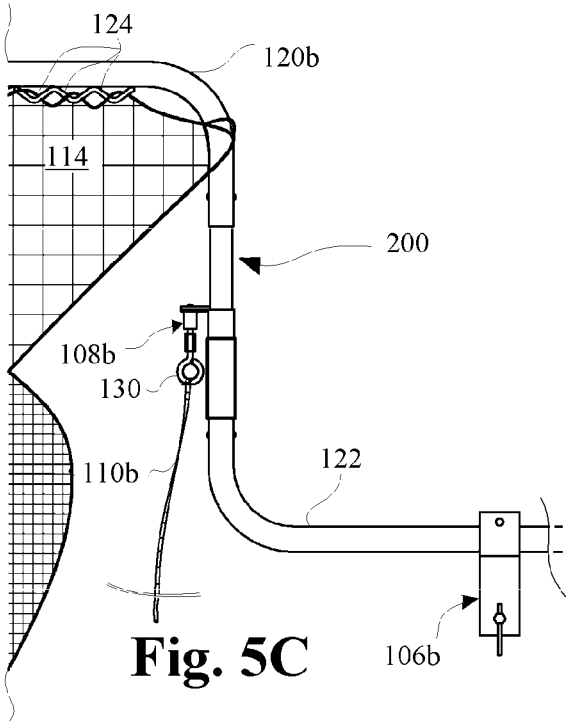
FIG. 5C depicts a front perspective view of a clamp member and a pivot member with the clamp member coupled to a portion of a U-shaped central member of the backstop device and the pivot member coupled to a portion of an arm member as well, as to a portion of the U-shaped central member of the backstop device of any of FIGS. 4A-4C.

FIG. 5B depicts a front perspective view of an embodiment of a pivot member 108 to facilitate selective arrangement of one or more first (arm or wing) members 120*a* or second members 128*b* of the backstop device 200, 300, 400. Specifically, a portion of an end of the pivot member 108 comprises a block member 134 having an opening 136 configured for coupling a portion of an end of the pivot member to a portion of an end (or to an opposite end) of the central member 122. A portion of an opposite end of the pivot member 108 may be coupled to the first (arm) member 120*a* (or the second member 120*b*). A portion of the pivot member 108 may further comprise an engaging (plate) member 132*a* having a spring-loaded pin assembly 126. An end of the spring-loaded pin assembly 126 may be coupled to a portion of a hook member 130. A portion of the hook member 130 may receive a chord, string, rope 110 and the like as described earlier. An opposite end of the spring-loaded pin assembly 126 may communicate with a receiving (plate) member 132*b* having one or more openings 128. In operation, when the opposite end of the spring-loaded pin assembly 126 selectively engages any of the openings 128, selective and secure rotation of the first or second (arm) members 120*a*, 120*b* may be accomplished as described previously above (see FIG. 4A and FIG. 4B with the associated descriptions).

FIG. 5C depicts a front elevation view or a better detailed aspect of a portion of the backstop device 200 having a clamp member 106*b* and a pivot member (or element) 108*b* coupled to a portion of the backstop device. Of course, the description of the portion of the backstop device 200, could also apply to other embodiments having these specific features. With reference to FIG. 5C, one or more netting members 114 may be coupled to a portion of a second (arm) member 120*b* of the backstop device 200. In an aspect, a portion of the netting members 114 may be coupled to the nook members 124 as described and illustrated with reference to FIG. 2C and FIG. 5 (above). Further, it should be noted that a portion of the netting members 114 may be coupled directly to a portion of the second (arm) member 120*b* without being coupled to the hook members 124. Additionally, as illustrated in FIG. 5C, a portion of a rope or chain 110*b* may be coupled to a portion of the hook member 130 to facilitate selective configuration of the pivot member 108*b* and thus provide selective and secure rotation of the first second (arm) members 120*b* (see description above).

Details related to pivoting of the first or second (arm) members 120*a*, 120*b* (and if configured the extension members 120*c*, 120*d*) may be understood by referring to FIGS. 5A-5D. In operation, in order to adjust a first or second (arm) member 120*a*, 120*b* to another position, the corresponding rope 110*a* (or 110*b*) may be pulled to release the spring-loaded pin 126 and thereby permit movement of the first or second (arm) member to a desired position. When a desired position has been accomplished, the spring-loaded pin 126 may engage an appropriate opening 128 of the receiving member 132*b* (described above) thereby setting the position of the first or second (arm) member 120*a*, 120*b*. Naturally, in an aspect of the disclosure it may be anticipated that a centralised rope 110 could set a pivot member's spring-loaded pins 126 simultaneously.

Figure 5D:
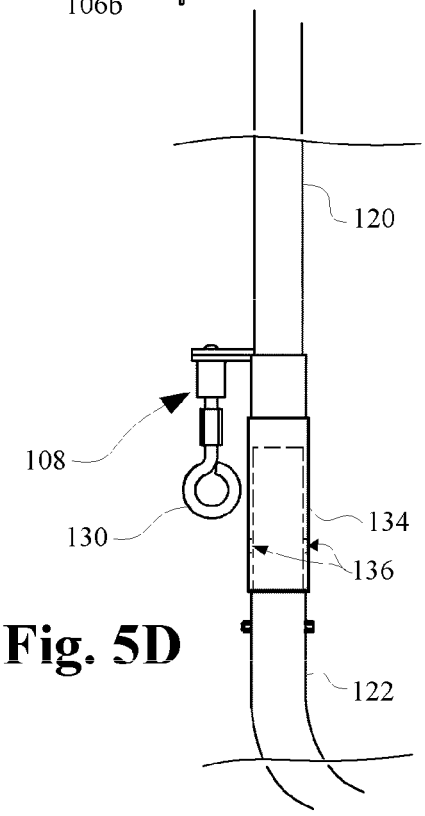
FIG. 5D depicts a more detailed side perspective view of the pivot member coupled to a portion of the arm member as well as to a portion of the U-shaped central member of the backstop device of any of FIGS. 4A-4C.

FIG. 5D depicts yet a scare detailed view of the pivot member 108 coupled to a portion of an end of a first or second (arm or wing) member 120*a*, 120*b* and a portion of an end of the central member 122 of the backstop device 200, 300 or 400.

Figure 5E:
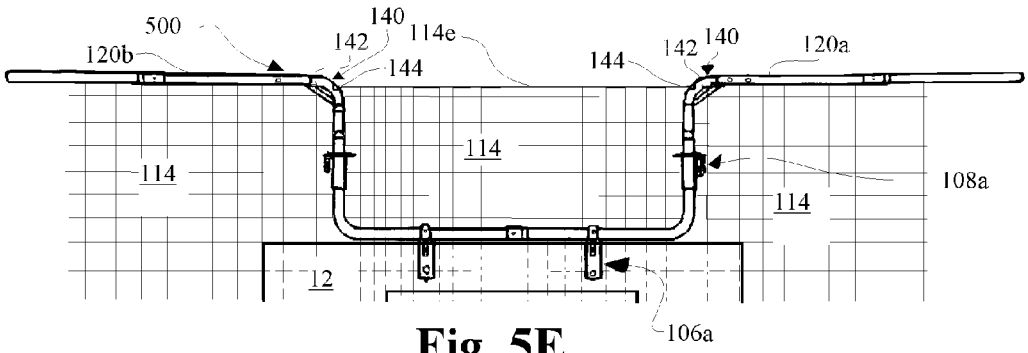
FIG. 5E depicts a front elevation view of another embodiment of a backstop device according to the current disclosure.

FIG. 5E depicts a front elevation view of yet another embodiment of a backstop device 500. In most respects the backstop device 500 is substantially identical to the backstop device 200. However, it should be noted the first (arm) member 120*a* and the second member 120*b* may comprise a "break-away" mechanism (see below for further details of a break-away assembly 140). The "break-away" mechanism may be configured to provide safety features to the backstop device 500 should an individual decide to climb the netting to reset the pivot members 108*a*, 108*b* rather than using a ladder as discussed previously. In most anticipated situations, the individual may be a child having a weight between about 50 pounds to about 120 pounds, although it is understood that one or more "break-away" mechanism elements may be configured for any weight grouping as desired. Further, the safety design feature may be adapted so that despite a tendency to cause unbalanced tilting of the backstop device, the "break-away" would not result in a disastrous break down of the backstop device 500.

Figure 5G:
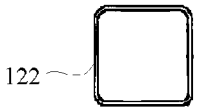
FIG. 5G depicts a sectional view through 5G-5G of the central member of FIG. 5F.
Figure 5F:
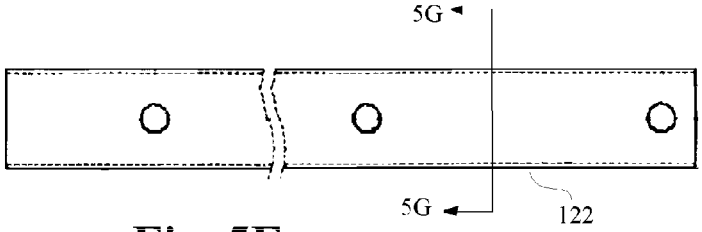
FIG. 5F depicts a front elevation view of a central member or a portion of another frame member of the backstop device of FIG. 5E.

FIG. 5F depicts a front elevation view of a portion of the central member 122 or, of course, a portion of either the first (arm) member 120*a* or the second (arm) member 120*b*). FIG. 5G depicts a cross-sectional view through 5F-5F of the central member 122. Although the central member 122 is shown as having a substantially square profile, naturally the shape or profile may be any desired shape.

Figure 5H:
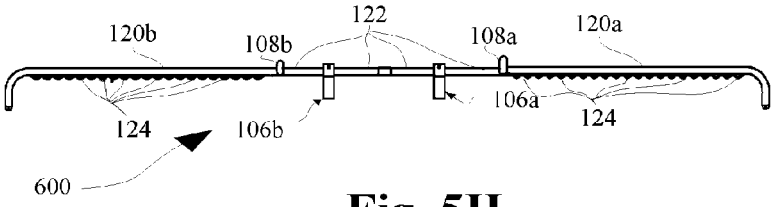
FIG. 5H depicts a front elevation view of yet another embodiment of a portion of a backstop device according to the current disclosure.

FIG. 5H depicts a front elevation view of yet another embodiment of a portion of a backstop device 600. Again, in most respects the backstop device 600 is similar to previously described embodiments of the backstop device. However, rather than having a U-shaped central member as described above, the backstop device 600 has a substantially straight-shaped central member 122. As illustrated, a portion of an end of the straight-shaped central member 122 may be coupled to a portion of an end of a first (arm) member 120*a*, while a portion of an opposite end of the straight member 122 may be coupled to a portion of an end of a second (arm) member 120*b*. As described earlier with respect to other embodiments of backstop devices, the backstop device 600 may further comprise one or more pivot members (hinges) 108*a*, 108*b*.

Figure 5K:
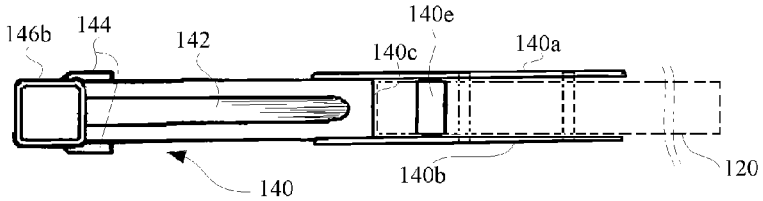
FIG. 5K depicts a bottom elevation view of a portion of the break-away assembly of FIG. 5I.
Figure 5J:
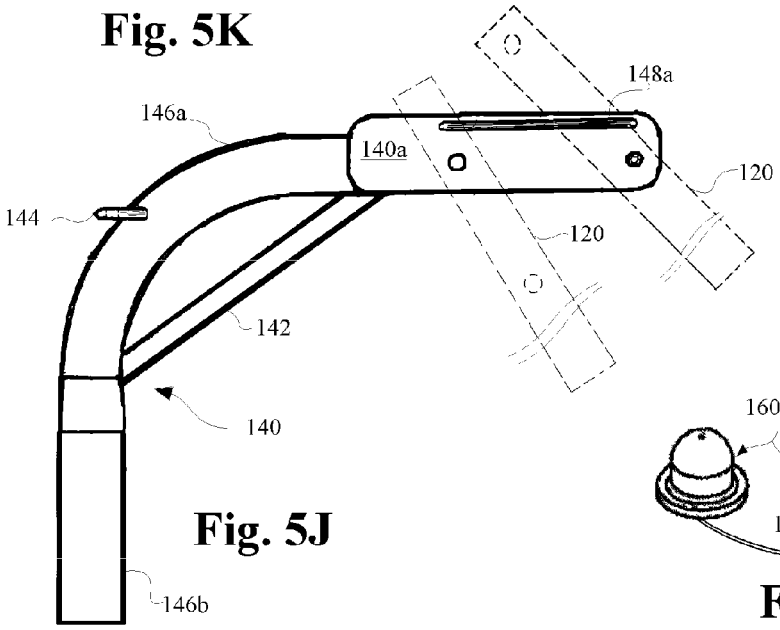
FIG. 5J depicts a front elevation view of a portion of the break-away assembly of FIG. 5I showing various potential couplings of a portion of a break-away arm in phantom lines to a portion of the break-away assembly.
Figure 5N:
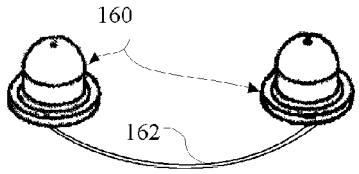
FIG. 5N depicts a front perspective view of a break-away pin of FIG. 5L coupled to another break-away pin.
Figure 5I:
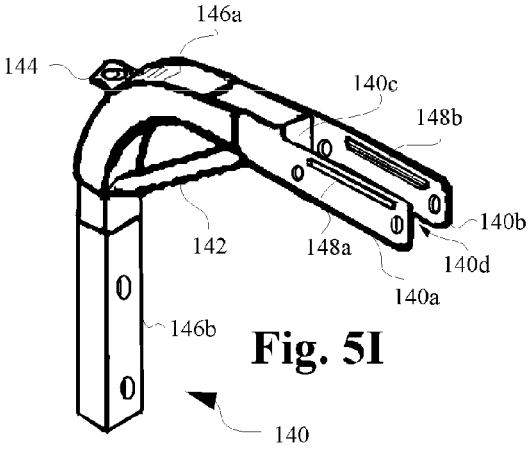
FIG. 5I depicts a front perspective view of a portion of a break-away assembly of the backstop device of FIG. 5E.

FIG. 5I depicts a front perspective view of a portion of a break-away assembly 140 of the backstop device 500. The break-away assembly 140 comprises a first wall member 140*a*, and a second wall member 140*b* and a third wall member 140*c*. The first, second and third wall members 140*a*, 140*b*, 140*c* define a channel 140*d* adapted to receive a portion of an arm member 120 (such as the first member 120*a* or the second member 120*b* as illustrated in FIG. 5E or as illustrated in FIG. 5F). Further, a portion of the surface of each wall member 140*a*, 140*b* may have one or more detents 148*a*, 148*b* respectively. The detents 148*a*, 148*b* may engage a portion of an outer surface of the first or second (arm) members 120*a* or 120*b*. In this manner, the detents 148*a*, 148*b* may frictionally communicate with a portion of the outer surface of the first or second (arm) members 120*a* or 120*b* and thus provide a "break-away" element.

Referring further to FIG. 5I, the break-away assembly 140 further comprises an elbow-shaped (or substantially L-shaped) member 146*a*. A portion of an end of the elbow shaped member 146*a* may be adjacent to the wall members 140*a*, 140*b*, 140*c* and may be contiguous with the wall members. Additionally, an opposite end of a portion of the elbow-shaped member 146*a* may be adjacent to an opposite end of a portion of an elongated member 146*b* having one or more openings. Again, as described with respect to the wall members 140*a*, 140*b*, 140*c*, the elbow-shaped member 146*a* and the elongated member 146*b* may be contiguous. Each of the wall members 140*a*, 140*b*, 140*c*, the elbow-shaped member 146*a* and the elongated member 146*b* may comprise any suitable material such as metals, plastics, composites and the like that would be suitably rigid under use conditions of the backstop device 500. The break-away assembly 140 may further comprise a reinforcement member 142, where a portion of a first end of the reinforcement member may be coupled (or adjacent) to a portion of the elbow-shaped member 146*a*. Similarly, a portion of an opposite end of the reinforcement member 142 may be further coupled (or adjacent) to an external portion of the break-away assembly 140 proximate to the wall member 140*c*. In yet another aspect, a loop member 144 has an opening configured to receive a portion such as 114*e* of the netting member 114 as further illustrated in FIG. 5E. The portion 114*e* of the netting member 114 may provide enhanced tension on an upper portion of the netting member.

FIG. 5J depicts a front elevation view of a portion of the break-away assembly 140 of FIG. 5I showing various potential couplings of a portion of a break-away arm member (the first or second members 120*a*, 120*b*) in phantom lines to a portion of the break-away assembly. According to FIGS. 5I and 5J, the wall member 140*a* has two openings (as does the wall member 140*b*). As depicted in FIG. 5J, a portion of each of the break-away arm members 120 has two openings. The openings of the break-away arm members 120 correspond to the openings of the wall members 140*a*, 140*b*. In an aspect, as illustrated by the phantom lines representing the break-away arm member 120*a* (or 120*b*), the break-away arm member may be pivotally coupled to either of the openings of the wall members 140*a*, 140*b*. Such coupling may be accomplished with a pin, screw, bolt and the like to permit pivoting about the bolt. The bolt or pin may comprise any suitable material as is understood in the art. One or more shear or break-away pins 160 (see the description with respect to FIGS. 5L-5N below) may pivotally engage the remaining corresponding openings of the wall members 140*a*, 140*b* and the break-away arm member 120. Thus, when engaged, the break-away arm member 120 and the break-away assembly 140 may be functionally equivalent to the first and the second (arm) members 120*a*, 120*b* described earlier with respect to the embodiments of the backstop device 200, 300, 400.

FIG. 5K depicts a bottom elevation view of a portion of the break-away assembly 140 of FIG. 5I. In particular, the elongated member 146*b* has a substantially hollow square shape. Further, an I-shaped support member 140*e* may be coupled to a bottom portion of the wall members 140*a*, 140*b* to securely receive a bottom portion of the break-away arm member 120.

Figure 5M:
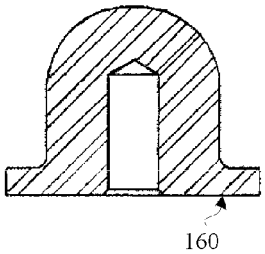
FIG. 5M depicts a sectional view through 5M-5M of she break-away pin of FIG. 5L.
Figure 5L:
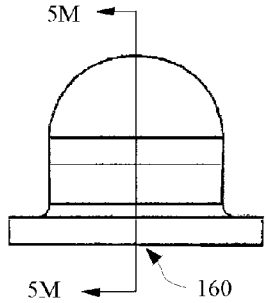
FIG. 5L depicts a front elevation view of an embodiment of a break-away pin configured for use with a portion of the break-away assembly of FIG. 5I.

FIG. 5L depicts a front elevation view of an embodiment of a break-away pin 160 configured for use with a portion of the break-away assembly of FIG. 5I. In operation a user may couple a portion of the break-away pin to the openings of the wall members 140*a*, 140*b* and the corresponding opening of the break-away arm member 120. In an aspect of the disclosure, the break-away pin 160 may comprise a plastic or any deformable metal. Of course, the break-away pin 160 may also comprise a shear sensitive bolt or a rivet as desired. If an individual climbed onto the netting, the break-away pin 160 would shear away according to a pre-defined shear force depending on the weight of the individual to provide a desired safety feature as described above.

FIG. 5M depicts a sectional view through 5M-5M of the break-away pin 160 of FIG. 5I. In particular, an inner portion of the break-away pin 160 may have a hollow shape. Thus, when the break-away pin 160 engages the openings as described above, the break-away pin may neck slightly to provide secure coupling to the openings of the wall members 140*a*, 140*b* and the corresponding opening of the break-away arm member 120. FIG. 5N depicts a front perspective view of a break-away pin 160 coupled to another break-away pin with a substantially flexible element 162.

Figure 5Q:
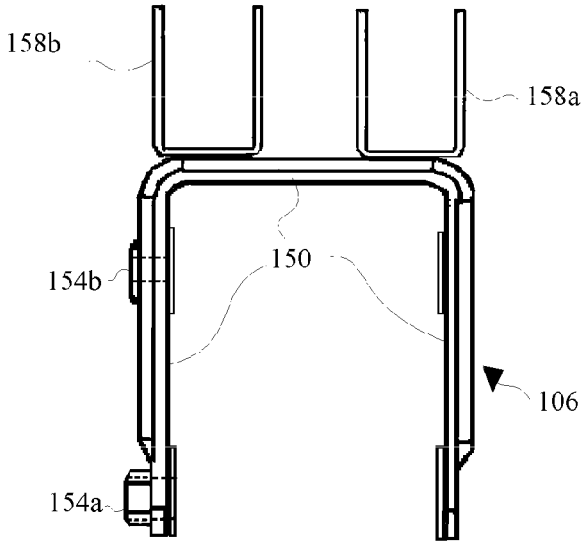
FIG. 5Q depicts a front elevation view of the clasp member of FIG. 5P.
Figure 5R:
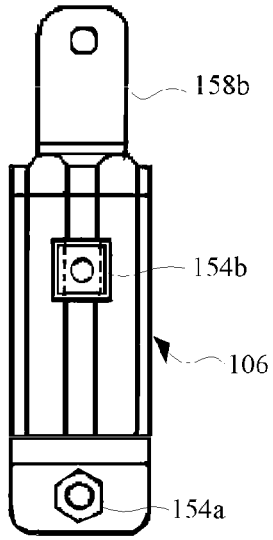
FIG. 5R depicts a side elevation view of the clamp member of FIG. 5P.
Figure 5P:
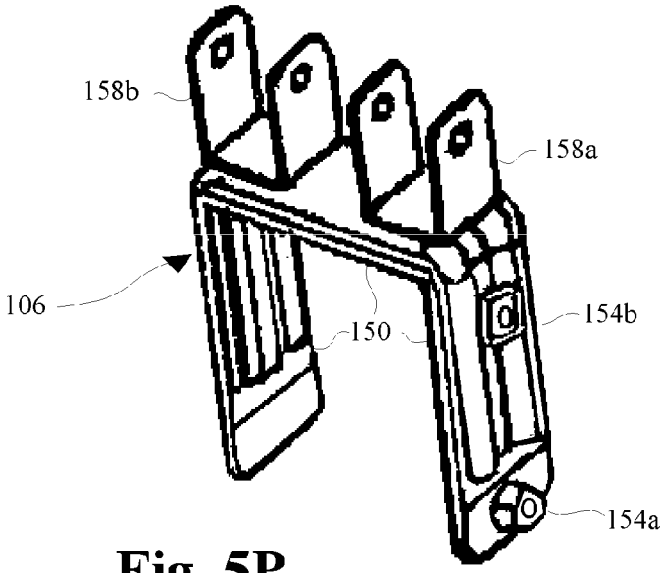
FIG. 5P depicts a front perspective view of an embodiment of a clamp member of any embodiment of a backstop device.

FIG. 5P depicts a front perspective view of another embodiment of a clamp member 106 of any of the backstop devices 100, 200, 300, 400, 500, 600. The clamp member 106 comprises a first side, a second side and a third side defining a substantially U-shaped side member 150 configured to engage a portion of a basketball backboard 12. Of course, the board 12 may be any type of sports front or backboard. The clamp member 106 may further comprise a first nut 154*a* and a second nut 154*b*, with each of the nuts configured to receive a pair of standard screw type adjusting members 152*a*, 152*b*

Figure 5S:
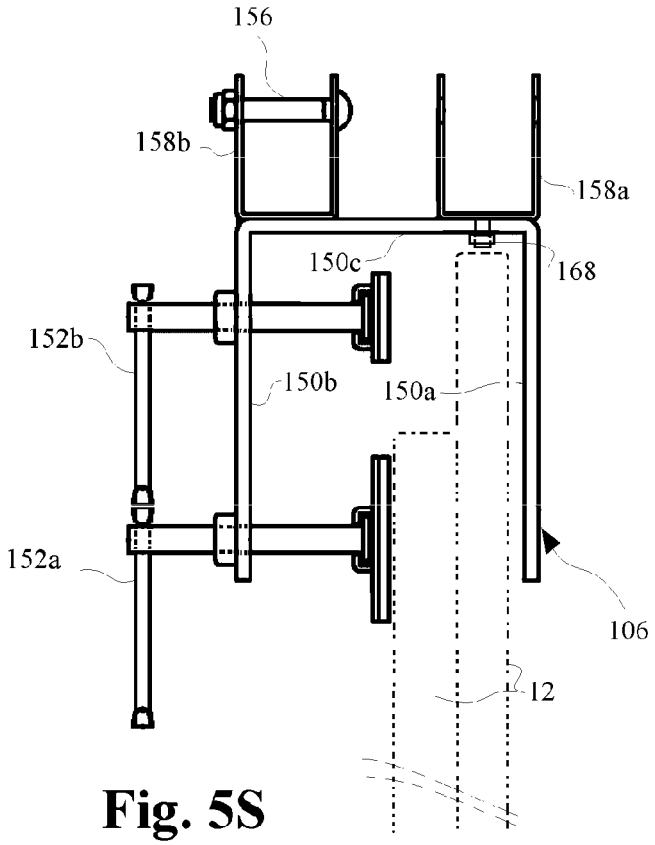
FIG. 5S depicts a side elevation view of the clamp member of FIG. 5P shown is detail and a portion of a backboard shown in phantom lines.

(see FIG. 5S). The clamp member 106 may further comprise two substantially U-shaped bracket members 158*a*, 158*b* having a first side element, a second side element and a third side element. A back outer portion of the second side element of each U-shaped bracket member 158*a*, 158*b* may be coupled to a back outer portion of she second side of the U-shaped side member 150. Each of the first and the third side elements of tee U-shaped bracket members may have an opening adapted to receive a bolt or pin 156 received by a nut (see FIG. 5S and the description below).

FIG. 5Q depicts a front elevation view of the clamp member 106 of FIG. 5P, while FIG. 5R depicts a side elevation view of the clamp member.

Figure 5T:
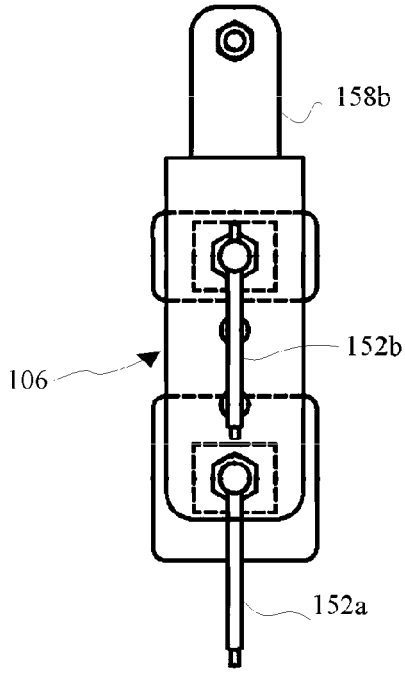
FIG. 5T depicts an end elevation view of the clamp member of FIG. 5S.

FIG. 5S depicts a side elevation view of the clamp member 100 of FIG. 5P including two standard screw type adjusting members 152*a*, 152*b* shown in detail and a portion of a basketball backboard 12 shown in phantom lines. As illustrated in FIG. 5S, an end of each clamp adjusting member 152*a*, 152*b* may engage a different portion of the basketball backboard 12 to secure the clamp member 106 to the basketball backboard. Furthermore, the openings of the first and the third side elements of the U-shaped bracket members 158*a*, 158*b* receive the bolt or pin 156 locked by a nut. The first U-shaped bracket member 158*a* may advantageously receive a portion of the central member 122 when the basketball backboard 12 is substantially rectangular shaped (see FIG. 4A), while the second U-shaped bracket member 158*b* may advantageously receive a portion of the central member 122 when the basket backboard 12 has a rounded shape (see FIG. 4B). Further, a portion of an outer side of the first U-shaped bracket member 158*a* may be selectively coupled to a portion of an outer side 150*c* of the side member 150 (shown with sides 150*a*, 150*b*, 150*c* in FIG. 5S and described below with respect to FIG. 5U). Naturally, such selective coupling may be accomplished in various ways as understood in the art (FIG. 5S shows fastener 168, which may comprise a wing nut and bolt arrangement or any other suitable arrangement). Of course, the clamp members 106 may be selectively coupled to the central member 122 and thus accommodate different types of boards 12 as desired. FIG. 5T depicts an end elevation view of the clamp member 100 of FIG. 5S.

Figure 5U:
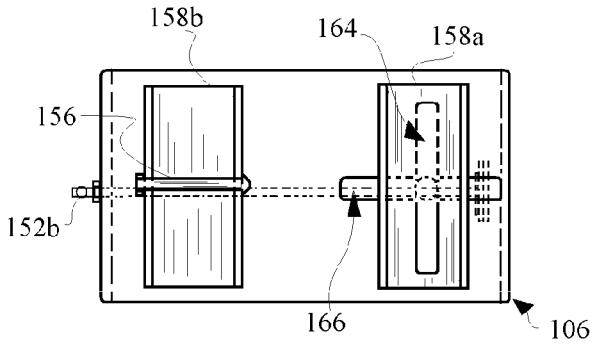
FIG. 5U depicts a top elevation view of the clamp member of FIG. 5S.

FIG. 5U depicts a top elevation view of the clamp member 106 of FIG. 5S. According to this view of the clamp member 106, a top portion of she side member 150*c* has one or more openings (two slots 164, 166 shown). The slots 164, 166 permit facile adjustment or the first U-shaped bracket member 158*a* to fit a portion of the central member 122 according to the backboard 12 configuration. As illustrated in FIG. 5U, the second U-shaped bracket member 158*b* may be substantially fixed in position relative to the first U-shaped member 158*a*. When the clamp 106 comprises a metal, the second U-shaped bracket member 158*b* may be fastened in any manner seed as welding, adhesively, mechanically coupled and the like as would be understood in the art.

Figure 5V:
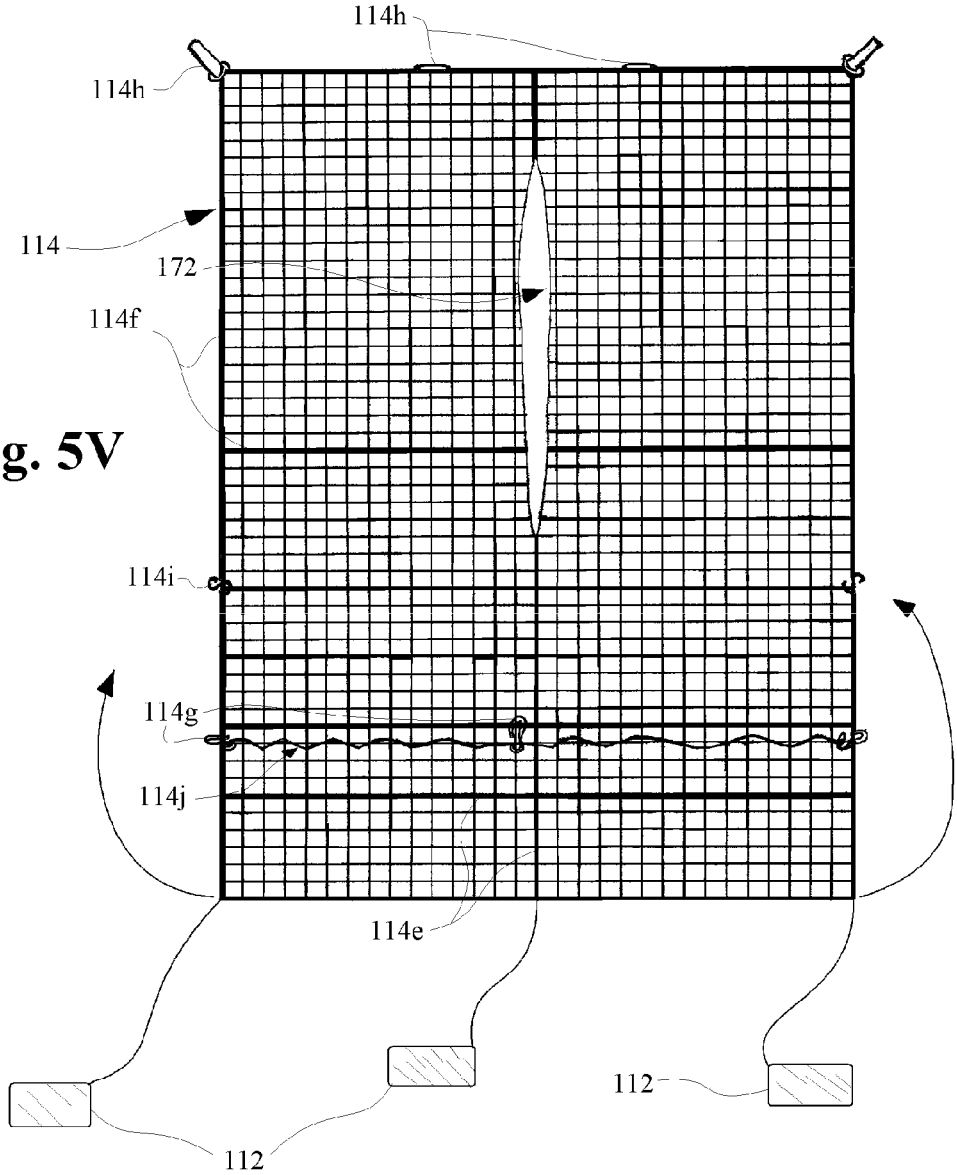
FIG. 5V depicts a front elevation view of an embodiment of a netting member in detail according to this disclosure.

FIG. 5V depicts a front elevation view of an embodiment of a netting member 114 in detail. As illustrated the netting member 114 may have an opening 172 or split as described above. The opening 172 facilitates placement of a portion of the netting member 114 about a backboard 12 or coupling of a portion of the netting member to a portion of the backboard with ties or hooks and the like as would be understood in the art. The netting member 114 may further comprise one or more stiffener members 114*f* such as roping or braiding and the like to better define the shape of the netting member coupled to the backstop device 100-600. Further, one or more fasteners 114*g* (D-rings), 114*h* (clips), 114*i* (S-hooks) may be coupled to a portion of the netting member 114 to facilitate fastening of the netting member to various components of the backstop device 100-600. In an aspect of the disclosure, a lower portion of the netting member 114 may be raised (shown by the arrows in FIG. 5V). One or more of the fasteners 114*h*, 114*i* may facilitate formation of the pocket 114*d* (illustrated in FIG. 5W, and described below). In yet another aspect, a rope 114*j* may thread through a portion of the netting member 114 as desired. Further, as shown elsewhere also, one or more weights 112 (described further below with reference to FIG. 5W) may be coupled to a portion of the netting member 114.

Figure 5W:
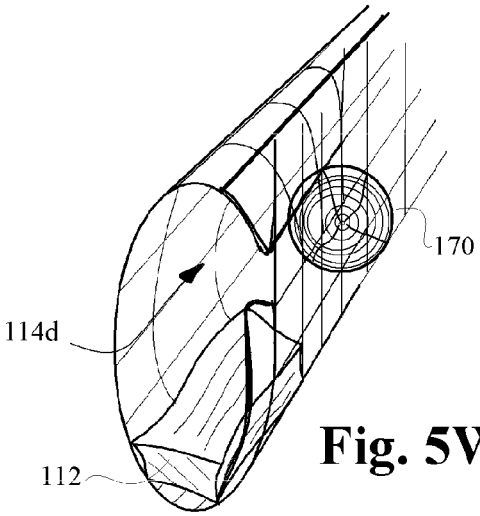
FIG. 5W depicts a side perspective view of a pouch formed by folding over a lower potion of a netting member including a weight and a ball enclosed in a portion of the pouch.

FIG. 5W depicts a side perspective view of a pouch 114*d* formed by folding over a lower portion of a netting member 114 including a weight 112 and a ball 170 enclosed in a portion of the pouch. Naturally, the weight 112 may comprise a sandbag, a water bag and the like that would securely hold a lower portion or the netting member 114 in place. It should be further noted that in operation, the weight 112 has been illustrated as being placed within the pocket to avoid having a user of the backstop device 100-600 trip on the weight. In another aspect of the disclosure, one or more of the weights 112 may be mounted behind the netting member 114 in proximity to the base member 16 thus preventing a user from tripping over the weights.

Figure 5X:
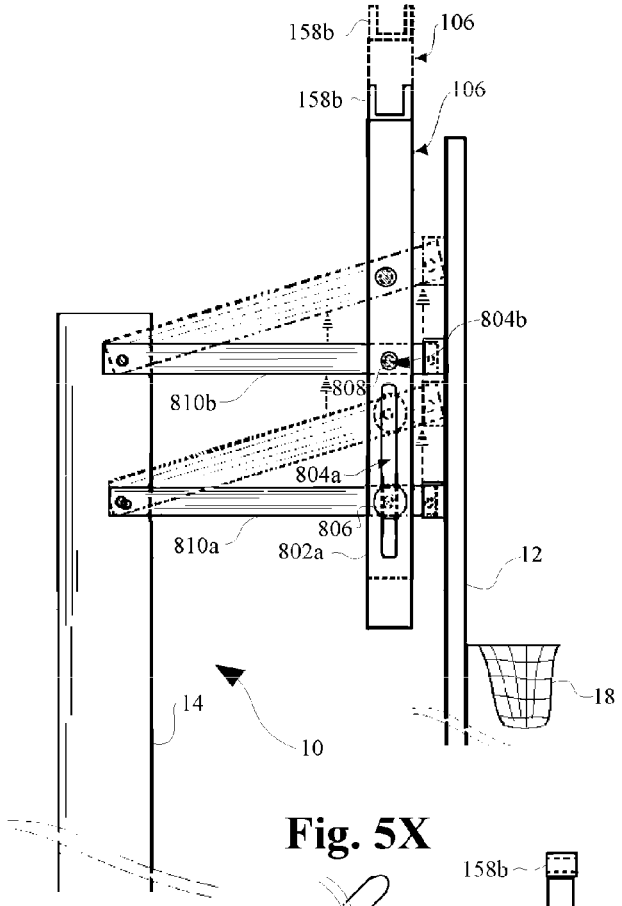
FIG. 5X depicts a side elevation view of yet another embodiment of a clamp member comprising one or more substantially rectangular elongated members coupled to one or more board arm members.

FIG. 5X depicts a side elevation view of yet another embodiment of a clamp member 106. The clamp member 106 may comprise one or more substantially rectangular elongated members 802 (only one shown, in FIG. 5X) having one or more openings (a slot 804*a* shown in solid lines and a hole 804*b* shown in dotted lines). The openings 804*a*, 804*b* are configured to receive one or more fasteners 806, 806 such as bolts, washers, nuts, wing nuts and the like as understood in the art. Naturally, either opening 804*a*, 804*b* may comprise a slot or the openings may comprise a single slot as desired. As illustrated in this side elevation view of FIG. 5X, the fasteners 806, 808 couple the elongated members 802 to a portion of and end of each of a pair of sliding board arm members 810*a*, 810*b* of a basketball board assembly 10 (see FIG. 3B showing two board arm members in perspective view). However, as shown in FIG. 5X there may be two sets of board arm members 810*a*, 810*b* and referring to FIG. 3B, as well as FIG. Y (see description below) it may be understood that there may be four arm members in total, as desired. As is understood in the art, sets of pairs of sliding board arm members 810*a*, 810*b* selectively raise and lower a basketball board 12 according to the needs of a user. Further, an end of each of the rectangular elongated members 802 may further comprise the U-shaped member 158*b* (or of course the U-shaped member 158*a*) configured to receive any of the backstop device's central member 122 and other features as discussed previously. The movement of the sliding arm members 810*a*, 810*b* is shown in FIG. 5X by the arrows and phantom lines to further clarify how connections are made with respect to this embodiment of the clamp member 106.

Figure 5Z:
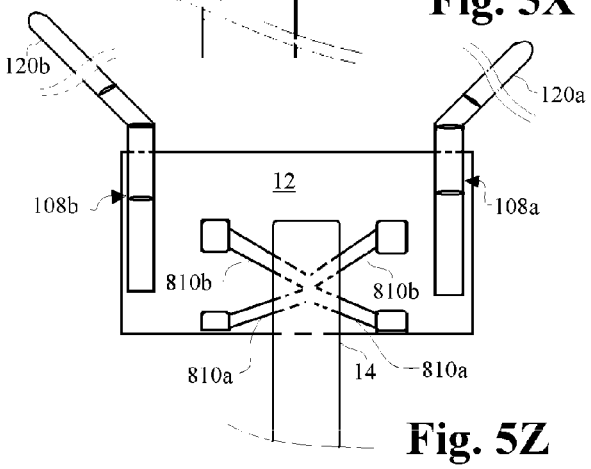
FIG. 5Z depicts a back elevation view of another embodiment of two pivot members coupled to a portion of a basketball backboard with each pivot member including an arm member.
Figure 5Y:
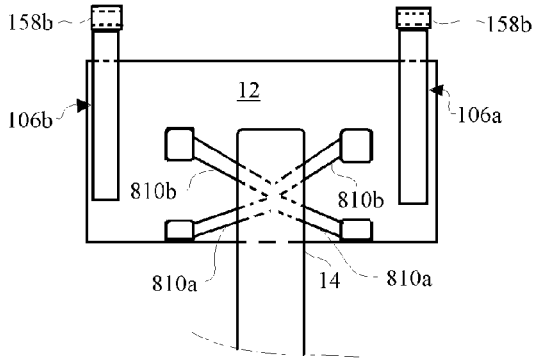
FIG. 5Y depicts a bask elevation view of another embodiment of a clamp member comprising one or more substantially rectangular elongated members coupled to a portion of a basketball backboard.

FIG. 5Y depicts an elevation view of the backside of the basketball board 12 configured with a pair of clamp members 106*a*, 106*b* coupled to a portion of the backboard instead of the board arm members 810*a*, 810*b*. The sets of pair of board arm members 158*a*, 158*b* couple to the pole member 14 of the basketball assembly 10 as discussed earlier. Further, an end of each of the rectangular elongated members 802 may further comprise the U-shaped member 158*b* (or of course the U-shaped member 158*a*) configured to receive any of the backstop device's central member 122 and other features as discussed previously.

FIG. 5Z depicts an elevation view of the backside of the basketball board 12 configured with a pair of pivot members (also designated as "connectors") 108*a*, 108*b* coupled to a portion of the backboard 12. Naturally, the pivot members 108*a*, 108*b* may have multiple pivoting points (three shown in FIG. 5Z merely for illustrative purposes). Further, the pivot members 108*a*, 108*b* may be configured as a single pivot member 108 with multiple pivot points as desired. Of course, the pivot members 108*a*, 108*b* may be positioned at any desired distance from the surface of the backboard 12 as a matter of convenience. Coupling of the pivot members 108*a*, 108*b* may be accomplished in any manner as is understood in the art such as for example by welding, with one or more adhesives, mechanically with screws or bolts and the like. In an aspect the coupling may simply result from integrated manufacturing of the backboard 12 and the pivot members 108*a*, 108*b*. In another aspect, a backboard assembly 10 (see description above for FIG. 3, where a backboard assembly has been discussed) may be offered as an entire unit having one or more pivot members 108 coupled to any portion of the backboard assembly as desired.

In a further aspect, it should be understood that each clamp member 106 may be merged with various other components such as pivot mechanisms and the like as discussed above to provide a support for one or more central members 122. Consequently, means to pivotally manipulate one or more netting members 114 of the backstop devices and thus provide yet other backstop device embodiments may be configured as desired.

Figure 6A:
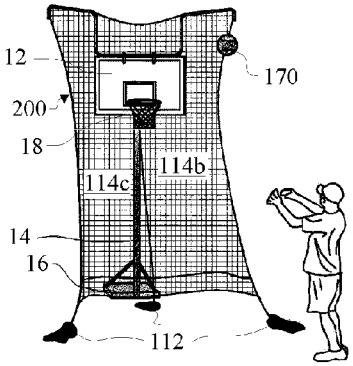
FIG. 6A-6G depict various front and side perspective views showing the backstop device of any of FIGS. 4A-4C coupled to a basketball backboard and how the backstop device may be configured for use to return and store balls thrown by a user.
Figure 6B:
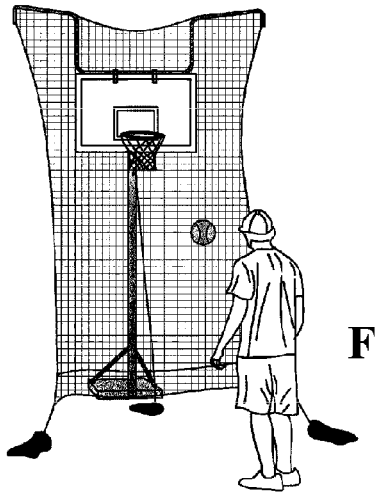
Figure 6D:
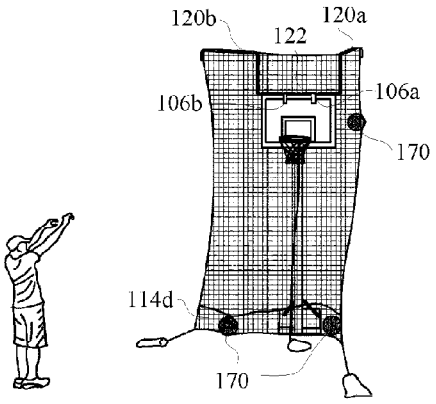
Figure 6C:
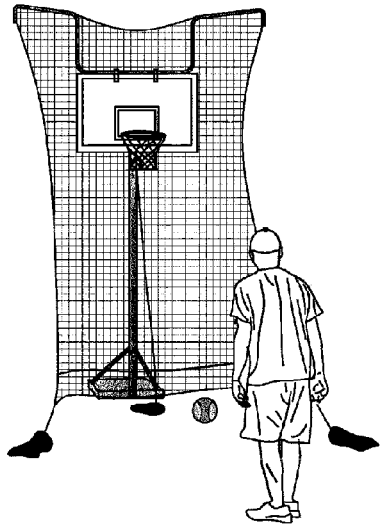

FIG. 6A-6G depict various perspective views showing the exemplary backstop device 200 coupled to a basketball backboard 12 and how the backstop device may be used to return and store balls 170 thrown by a user. FIG. 6A illustrates a player throwing a practice ball 170 towards a hoop 18 of the backboard 12. In FIG. 6B, the player has missed the hoop 18 and the ball 170 rolls along the netting member 114 to be returned to the user as illustrated in FIG. 6C. As discussed above, a third sandbag (or weight) 112 may be coupled to a lower portion of the netting members 114 to provide ball directionality. Naturally, the third weight may be unnecessary when a lower portion of the netting members 114 is coupled to the base member 16 or the pole member 14.

FIG. 6D illustrates a different configuration of the backstop device 200 wherein a lower portion of the netting member 114 has been folded to receive one or more balls 170 (as described above). The first and second members 120*a*, 120*b* and the netting member 114 may be configured so that each time the user throws the ball 170, instead of roiling back to the user on missing the hoop 18, the ball 170 may captured by one or more pockets configured in the lower portion of the netting member 114.

Figure 6E:
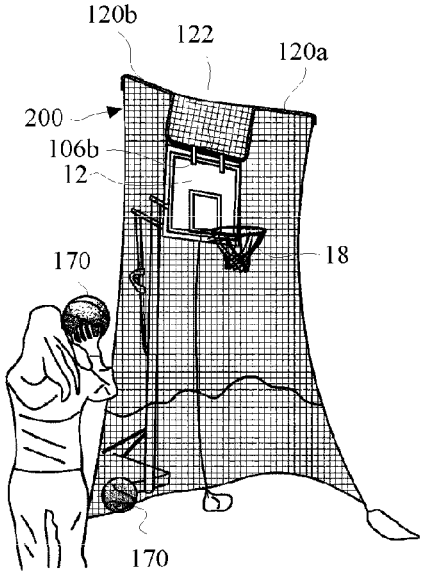
Figure 6F:
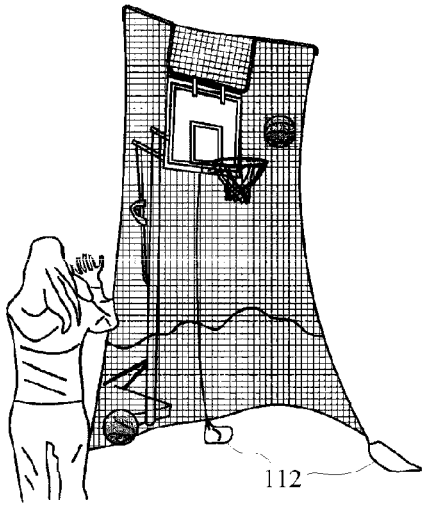
Figure 6G:
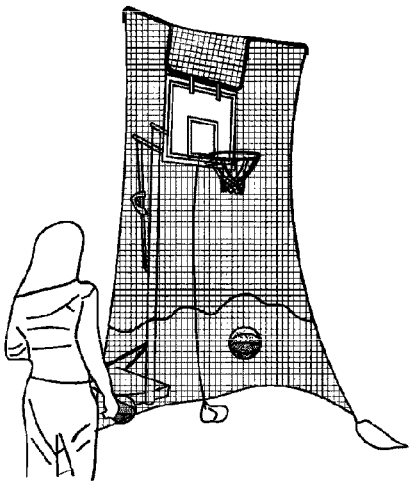

FIG. 6E illustrates yet another configuration of the first and second members 120*a*, 120*b* of the backstop device 200 wherein a user stands to one side of the basketball backboard 12. In FIG. 6F the user has missed the hoop 18 and the ball 170 may be caught by one or more of the netting members' pockets 114*d* (see also FIGS. 3A-3B). FIG. 6F also illustrates that a previously thrown ball 170 may be captured in the pocket of a lower portion of the netting member 114. In FIG. 6G, the ball 170, which had been thrown by the user previously rolls into another pocket 114*d* of a lower portion of one or more netting members 114.

In general terms, according to one or more aspects of the disclosure, a repositionable backstop device may be coupled to any pre-existing structure, such as a portion of a backboard system and configured appropriately to provide a universally repositionable backstop assembly for conveniently retrieving missed or practice shots. The repositionable backstop device may comprise one or more pivot components that facilitate configuration of a frame portion of the backstop device. In this manner the frame portion may be configured so that a user of the repositionable backstop device may control the directions in which a missed or practice shot rolls. Additionally, it will be appreciated that the repositionable backstop device may be configured for use as for golf chipping and driving, tennis, soccer, badminton, hockey, baseball, or any similar type of sport where a backboard element exists. In general, the backstop devices described herein are light in weight, easily assembled and installed, and may be provided in one or more kit forms for ease of shipping and storage. The netting member may be suspended from any appropriate portion of the backstop device that includes one or more pivotal members that may be selectively re-arranged in any suitable configuration. Since a user may rearrange positioning of the members by simply pulling a string coupled to one or more pivot members, no ladders are required, thereby providing safety to the user. Furthermore, as illustrated above the backstop device may be re-positioned when not in use and balls may be further stored conveniently.

Various methods may be employed to assemble and configure any of the backstop devices discussed above. Without limiting the disclosure, an exemplary method includes one or more of the following steps. The order of the steps is not intended to necessarily limit the method.

In a step S1, a portion of an end of a first central member 122 may be coupled to a portion of an end of a second central member 122. In a step S2, a portion of an end of a first pivot member 108 may be coupled to a portion of an opposite end of the first central member 122. Similarly, in a step S3, a portion of an end of a second pivot member 108 may be coupled to a portion of an opposite end of the second central member 122. In a step S4, a portion of an opposite end of the first pivot member 108 may be coupled to a portion of an end of a first break-away assembly 140. In a step S5, a portion of an opposite end of the second pivot member 108 may coupled to a portion of an end of a second break-away assembly 140. In a step S6, a portion of an opposite end of the first break-away assembly 140 may be coupled to a portion of an end of a first arm member 120. In a step S7, a portion or an opposite end of the second break-away assembly 140 may be coupled to a portion of an end of a second arm member 120. In a step S8, a portion of one or more edges of one or more netting members 114 may be coupled to a portion of the arm members 120. In a step S9, on or more clamp members 106 may be coupled to a portion of a backboard 12. Thereafter, in a step S10, the central members 122 of the semi-assembled backstop device (see steps S1-S8) may be coupled to a portion of the clamp members 106. In a step S11, one or more weights 112 may be coupled to a lower portion of tee one or more netting members 114 as desired. Further in a step S12, one or store portions of the one or store netting members 114 may be coupled to various other components of a backboard assembly 10 as desired. In yet a further step S13, a lower portion of the one or mere netting members 114 may be folded to provide one or more pockets 114*d* as desired. In a further step S14, one or more of the arm members 120 may be manipulated by accessing the pivot members 108 to swing the one or more arm members in a desired direction.

Figure 7:
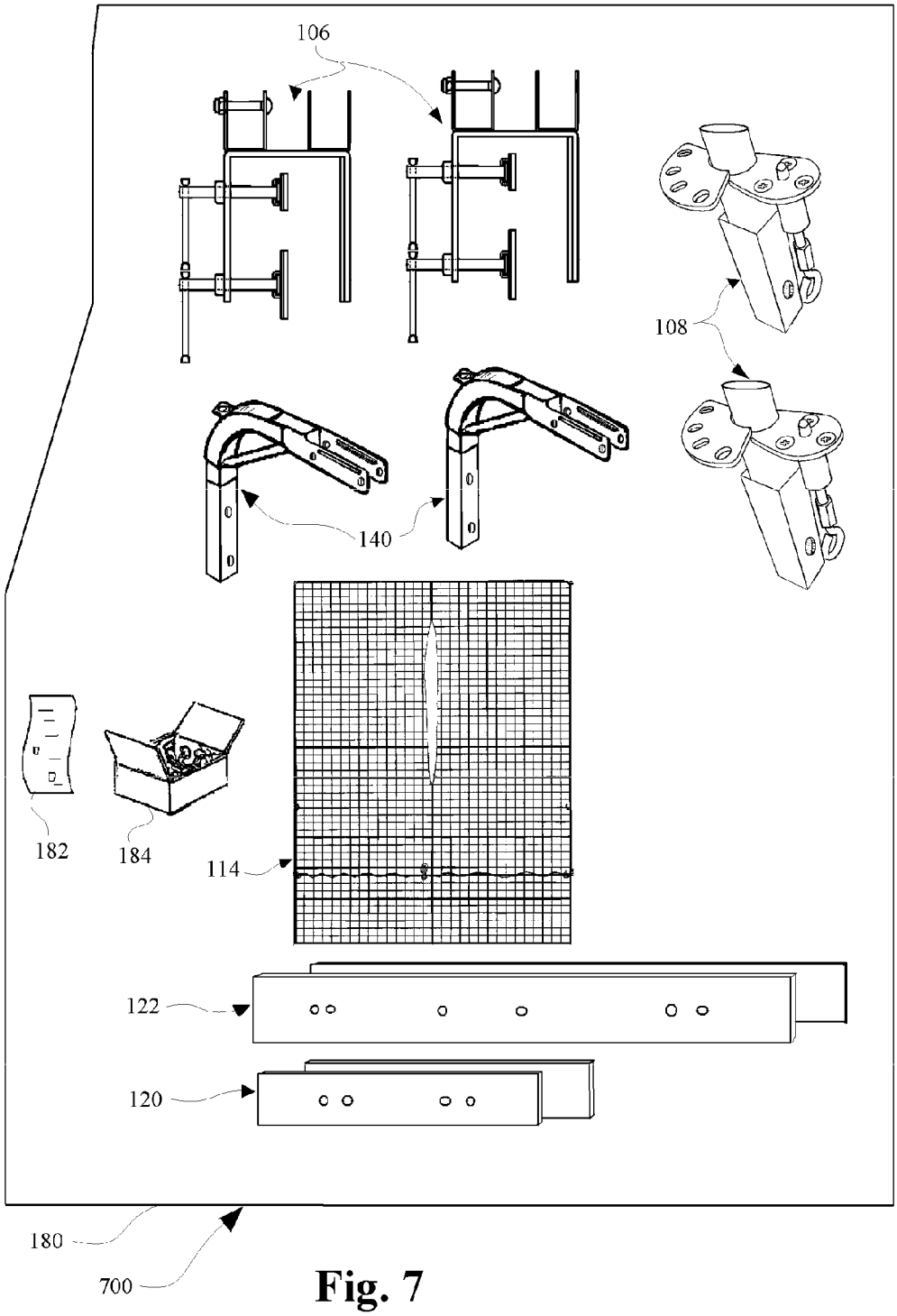
FIG. 7 depicts a front perspective view of an embodiment of a kit according to this disclosure.

FIG. 7 depicts a front perspective view of an embodiment of a kit 700. As illustrated the kit 700 may comprise numerous components. Such components may include one or more clamp members 106, one or more breakaway assemblies 140, one or more break-away arm members 120, one or more portions of a central member 122, one or more pivot members 108, one or more netting members 114, a set of assembly instructions 182 and a set of parts such as clips, clamps, screws, bolts, nuts, shear pins and the like as described above located in a container 184. Furthermore, a packaging material 180 may surround these components. Naturally, the kit 700 is not limited to the specific components illustrated in FIG. 7 and may be varied according to desire. Furthermore, of course, more than one packaging material 700 may be used. The packaging material 700 may be substantially transparent, translucent or opaque as desired and may further comprise various inscriptions, offers and protective components suitable for shipping and/or display of the kit 700.

It will be further appreciated from the descriptions above, that any of the back stop devices may be adapted for use with any backboard assembly 10. Such backstop devices may comprise a support member (central member) 122 positioned adjacent to a portion of the backboard assembly 10. At least one netting member 114 may be coupled to a portion of the support member 122. In this manner the netting member 114 may be positioned to deflect a ball 170 in a direction determined by the position of the at least one netting member. Further, the support member 122 may be positioned in front of a backboard 12 of the backboard assembly 10. Additionally, the support members 122 may be positioned behind the backboard 12. Naturally, the support member 122 may be positioned flush with the backboard 12. In yet another aspect, the support member 122 may be attached to a horizontal rear support of the backboard assembly 10. The horizontal rear support may be coupled to a portion of the backboard 12.

Furthermore, the back stop device may comprise a coupler (or connector or clamp) 106 configured to selectively couple a portion of the support member 122 to a perimeter portion of the backboard assembly 10. Further, at least a portion of the support member 122 may extend a distance above a top edge or any edge of the backboard 12. Additionally, at least a portion of she support member 122 may extend a distance to the side of the backboard 12.

While the invention has been particularly shown and described with reference to preferred embodiments thereof, it will be understood by those skilled in the art that the foregoing and other changes in form and details may be made therein without departing from the spirit and scope of the invention.

The scope of the present invention is not intended limited by the specific examples set out herein, but rather is to be interpreted according to the following claims. For example, as is readily apparent from the description above, one or more components may be used independently of the other components. One or more of the components may be integrally stored with the backboard when not in use or removed for attachment upon other structures such as hockey and soccer goals, football uprights and the like. Of course, a portion of the backstop device may comprise a target for pitching etc., and when balls roll down the netting members they may be collected in one or more pockets of the backstop device. Furthermore, the backstop device and a backboard element may be co-configured and sold as a single unit. In yet another aspect the backstop device may be offered as a kit in one or more packages having assembly instructions as well as all required fasteners.

What is claimed is:

1. A kit that when assembled forms a backstop device configured to be coupled to a backboard, the kit comprising:

one or more clamp members;

one or more breakaway assemblies;

one or more break-away arm members;

one or more portions of a central member, configured to be pivotally adjustable along a first axis, wherein the central member is configured to be positioned above and co-planar with or behind the backboard when the kit is assembled;

one or more pivot members, configured to be pivotally adjustable along a second axis, independent of the rotation of the central member;

one or more netting members;

at least one set of fasteners; and at least one set of assembly instructions, wherein said kit is surrounded by at least one packaging material.

2. A basketball backboard assembly:

a basketball backboard;

a support assembly for the basketball backboard;

a central member having a first end and a second end, the central member pivotally adjustable along a first axis and positioned above and co-planar with or behind the basketball backboard;

a connector configured to couple the central member to the basketball backboard; a first pivot member and a second pivot member, wherein the first end of the central member is coupled to the first pivot member and the second end of the central member is coupled to the second pivot member, said first and second pivot members being pivotally adjustable along a second axis, independent of the rotation of the central member;

at least one arm member pivotally coupled to a portion of the first pivot member, wherein the at least one arm member is selectively repositionable, wherein each of the first and second pivot members include an adjustable securing mechanism positioned between the central member and the at least one arm member, the adjustable securing mechanism having a plurality of preset positions to lock the position of the at least one arm member relative to the central member;

at least one netting member coupled to the at least one arm member, said netting member configured to deflect a ball in a direction determined by the position of the at least one arm member; and a release rope coupled to the at least one arm member permitting repositioning of the at least one arm member in a direction around the second axis.

3. The backstop device of claim 2, further comprising:

a release rope coupled to the adjustable securing mechanism to unlock the adjustable securing mechanism and allow repositioning of the at least one arm member.

4. A backstop device, comprising:

a central member having a first end and a second end, the central member pivotally adjustable along a first axis and positioned above and co-planar with or behind a basketball backboard;

a connector configured to couple the central member to the basketball backboard;

a first pivot member and a second pivot member, wherein the first end of the central member is coupled to the first pivot member and the second end of the central member is coupled to the second pivot member, said first and second pivot members being pivotally adjustable along a second axis, independent of the rotation of the central member;

at least one arm member pivotally coupled to a portion of the first pivot member, wherein the at least one arm member is selectively repositionable, the at least one arm member having a break-away assembly configured to release a portion of the at least one arm member in response to a force that exceeds a predetermined amount; and at least one netting member coupled to the at least one arm member, said netting member configured to deflect a ball in a direction determined by the position of the at least one arm member.

5. The backstop device of claim 4, wherein the break-away assembly comprises a first wall member and an opposing second wall member, each of said wall members defining a channel configured to receive the portion of said at least one arm member.

6. The backstop device of claim 5, further comprising:

a reinforcement member having a first end and a second end, a portion of said first end coupled to a portion of said break-away assembly, and a portion of said second end of said reinforcement member coupled to a portion of said break-away assembly adjacent to said first end.

* * * * *